US006881154B2

(12) United States Patent
Neskudla et al.

(10) Patent No.: US 6,881,154 B2
(45) **Date of Patent: *Apr. 19, 2005**

(54) DEVICE FOR PRACTICING GOLF

(75) Inventors: Rudolph John Neskudla, 8 Landon Way, Mount Claremont, Western Australia 3010 (AU); Carmelo Giovanni Micalizzi, Nedlands (AU); Timothy John Walmsley, Welshpool (AU)

(73) Assignee: Rudolph John Neskudla, Mount Claremont (AU)

( * ) Notice: Subject to any disclaimer, the term of this patent is extended or adjusted under 35 U.S.C. 154(b) by 52 days.

This patent is subject to a terminal disclaimer.

(21) Appl. No.: 10/360,370

(22) Filed: Feb. 6, 2003

(65) Prior Publication Data

US 2003/0146576 A1 Aug. 7, 2003

Related U.S. Application Data

(63) Continuation-in-part of application No. 09/743,147, filed as application No. PCT/AU99/00553 on Jul. 8, 1999, now Pat. No. 6,749,520.

(30) Foreign Application Priority Data

Jul. 8, 1998 (AU) ..... PP4563
Aug. 21, 2002 (AU) ..... 2002950922

(51) Int. Cl.[7] ..... A63B 69/36

(52) U.S. Cl. ..... 473/197; 473/432; 273/400

(58) Field of Search ..... 273/395, 396, 273/398–402; 473/197, 454, 455, 456, 476, 478, 150, 172, 195

(56) References Cited

U.S. PATENT DOCUMENTS

| | | | |
|---|---|---|---|
| 1,788,803 | A | 1/1931 | MacGeorge |
| 2,043,273 | A | 6/1936 | Watson |

(Continued)

FOREIGN PATENT DOCUMENTS

| | | |
|---|---|---|
| AU | 79403/91 | 1/1992 |
| GB | 2140311 A | 11/1984 |
| WO | WO 85/02549 | 6/1985 |
| WO | WO 00/02629 | 1/2000 |

OTHER PUBLICATIONS

International Search Report dated Jul. 28, 1999.

*Primary Examiner*—Mark S. Graham
(74) *Attorney, Agent, or Firm*—Merchant & Gould P.C.

(57) ABSTRACT

A device for practicing ball sports comprising an enclosure (3) defined by a membrane supported from a self-supporting structure (7), the structure (7) comprising a base (8) having a playing surface (19) and having a forward edge (2) and a support means (9, 10) spaced forwardly and upwardly of the base (8) and supported at least in part from the base (8), the structure (7) further comprising an upstanding frame (11) supported from the sides (12,13) of the base (8) and extending over the base (8), the enclosure (3) being supported from the structure (7) to define a space (6) having an open end (4) and a closed end (5), the space (6) being of a general conical configuration, the open end (4) being supported from the base (8) to maintain the open end (8) in an open condition adjacent the forward edge (2) and the closed end (5) being supported from the support means in spaced relation to the open end (4), wherein the lower portion of the enclosure (3) is inclined downwardly from the closed end (5) to the base (8) to enable a ball thereon to return to the playing surface (19).

31 Claims, 24 Drawing Sheets

U.S. PATENT DOCUMENTS

| | | | |
|---|---|---|---|
| 2,123,195 | A | 7/1938 | Middleton |
| 3,895,809 | A | 7/1975 | Shockley |
| 4,556,219 | A | 12/1985 | Tillery |
| 4,815,736 | A | 3/1989 | Wright |
| 4,858,922 | A | 8/1989 | Santavaci |
| 5,018,731 | A | 5/1991 | Doyle |
| 5,088,740 | A | 2/1992 | Peterson |
| 5,244,213 | A | 9/1993 | Armell |
| 5,269,527 | A | 12/1993 | Noval |
| 5,433,433 | A | 7/1995 | Armell |
| 5,467,990 | A | 11/1995 | Kitzhaber |
| 5,492,319 | A | 2/1996 | Lee |
| 5,823,885 | A | 10/1998 | Stempfer |
| 6,319,145 | B1 | 11/2001 | Coughlan |

DEVICE FOR PRACTICING GOLF

This application is a Continuation-In-Part of U.S. application Ser. No. 09/743,147 filed 5 Jan. 2001, now U.S. Pat. No. 6,749,520, which is a National Stage Application of PCT/AU99/00553, filed on 8 Jul. 1999.

FIELD OF THE INVENTION

The present invention relates to apparatus for practising ball sports. It is particularly suited to the practice of golf but is readily adaptable to other ball sports.

BACKGROUND ART

A wide variety of practice nets for ball sports have been attempted. Golf is a particular sport where a compact practice net has been found to be most desirable but which has been quite difficult to successfully provide due to the particular problems associated with the practice of that sport. Hereinafter, this description will describe the invention with respect to the art of golf and its application for practising golf. However, it is to be recognised that the invention disclosed herein is readily adaptable to other ball sports.

Many attempts have been made to provide a golf practise net to enable a person to practise hitting a normal golf ball. Typically, such devices incorporate a net or other membrane arranged to receive the ball struck by the person, the net being supported by some type of frame. However, many of these types of apparatus suffer from the disadvantage of not being portable such that the golfer can practise striking the ball at any desired location. For many, also, the net must be placed forward of the person rendering quite likely that if the person does not strike the ball accurately, the ball will miss the target completely. This limits places where such nets can be used to locations where it does not cause a problem if the ball is mis-hit and misses the net. In general, those that are relatively portable require support by insertion of support stakes into the ground or attachment of support means to a nearby fixtures. This prevents use in average indoor domestic environments. Another problem usually facing such nets is that the balls once struck remain at the net so that it is necessary to walk to the net after hitting a group of balls to collect the balls. Yet another problem that has been common is that the nets have had very limited durability when struck by balls hit by skilled users, as such users can impart very considerable momentum and energy to a golf ball. The impact of a high energy ball upon the net causes damage which leads to rapid deterioration of the net. If a net or membrane of sufficient strength is used to prevent rapid deterioration, the apparatus becomes too heavy for easy portability.

Some attempts have been made to overcome these problems. A number such as those disclosed in U.S. Pat. No. 5,048,731 (Doyle) and U.S. Pat. No. 4,556,219 (Tillery) have provided nets which fully enclose the player to ensure that any mis-hit ball is certain to strike the net. While such devices are effective in avoiding accidents, they must of necessity be so large that they cannot be used in ordinary domestic environments where the height is limited. GB2140311 (Collings) discloses an apparatus having a conical shaped net having an open end supported from an arched frame and a closed end supported forward of the arched frame from a support member extending from the top of the arched frame. Side panels may be supported from the upright members of the arched frame and extending rearwardly of the user to be held in the ground by pegs or stakes.

However, for domestic use, the disclosure proposes that the net may be disconnected from the frame and support and suspended from convenient fixtures.

The preceding discussion of the background to the invention is intended only to facilitate an understanding of the present invention. It should be appreciated that the discussion is not an acknowledgement or admission that any of the material referred to was part of the common general knowledge as at the priority date of the application.

DISCLOSURE OF THE INVENTION

Accordingly, the invention resides in golf practice device comprising a base having a perimeter edge and an upper surface bounded by the perimeter edge, a portion of the upper surface providing a playing surface upon which a person using the device stands whilst striking a golf ball that rests relative to the playing surface;

an elongate enclosure for catching the golf ball when struck, the enclosure formed of a membrane and comprising an open end and a closed end with side walls therebetween and having a lower portion of the enclosure extending from the closed end to the base;

wherein the perimeter of the open end extends upwardly from each side of a rear portion of the playing surface;

a resilient elongate support fixed at each end to the sides of the base and supporting the upper portion of the open end of the enclosure;

a support adapted to support the closed end of the enclosure forward of the base wherein, in use, the support applies a tension to the enclosure between the closed end and open end to cause the resilient elongate support to flex forwardly such that the perimeter is inclined forwardly with respect to the base.

According to a preferred feature of the invention, a segment of the perimeter of the open end underlies the base from the each side of a rear portion of the playing surface.

According to a preferred feature of the invention, the net is formed from cylindrical construction.

According to a preferred embodiment, the open end is oblique relative to the cylindrical axis.

According to a preferred embodiment, the closed end is transverse relative to the cylindrical axis.

According to a preferred embodiment, the support that supports the closed end is not connected to the base.

According to a preferred embodiment, the ends of the resilient elongate support are fixed to the sides of the base intermediate opposite ends of said sides.

According to a preferred embodiment, the edge of the open end is supported by a resiliently flexible member.

According to a preferred feature of the invention, the top of the open end is disposed at a height that is not greater than the height of an average man standing on the playing surface According to a further aspect, the invention also resides in a golf practice device, comprising;

a base having a front, a rear, and a pair of sides, and defining a playing surface upon which a person using the device is intended to stand during use, the playing surface being defined between the front, rear and sides of the base;

a flexible, resilient, elongate, upstanding frame element extending upwardly from the sides of the base intermediate the front and the rear of the base, said frame having an uppermost point;

an enclosure having an open end and a closed end, the open end being supported by the upstanding frame;

a free standing support;

the enclosure being supported in the vicinity of the closed end by the free-standing support forwardly of the front of the base to apply tension to the enclosure between the closed end and the open end whereby the enclosure defines an elongate space which is divergent from the closed end to the open end;

the enclosure having a lower portion between the closed end and the front of the base that is inclined downwardly from the closed end to enable a ball to return to the playing surface, and the open end extending rearwardly from the upstanding frame along each side of the base to adjacent the rear of the base to thereby define lateral portions rearwardly of the upstanding frame element;

each lateral portion decreasing in height from the upstanding frame element to adjacent the rear of the base wherein the enclosure is formed of a membrane which, when the devices is erected, is able to be deflected when struck by a driven golf ball to thereby absorb a significant proportion of the kinetic energy of the golf ball.

According to a preferred feature of the invention, a segment of the open end underlies the base from each side rearwardly of the upstanding frame element.

According to a preferred feature of the invention, the frame element is caused to be resiliently deflected forwardly by the tension created in the enclosure by the free-standing support.

According to a preferred feature of the invention, the frame element is able to resiliently flex upon a golf ball impacting the membrane to absorb some kinetic energy of the golf ball.

According to a preferred feature of the invention, the frame element is able to resiliently flex forwardly or sidewardly or both forwardly and sidewardly on said impact.

According to a preferred feature of the invention, the membrane comprises netting.

According to a preferred embodiment, the free-standing support comprises an element adapted to receive a counterweight.

According to a preferred embodiment, the free-standing support comprises a support structure adapted to support the enclosure above a supporting surface, the support structure comprising contact portions adapted to contact the supporting surface at positions intermediate the base and the closed end.

According to a preferred embodiment, the support structure comprises a body and a pair of arms, the arms extending from the body to contact the supporting surface at positions intermediate the base and the closed end.

According to a preferred embodiment, the arms extend laterally from the body in opposed directions to provide clearance from the membrane.

According to a preferred feature of the invention, the sides of the base converge from the rear to the front.

According to a preferred embodiment, the base is substantially trapezoidal in shape.

According to a preferred embodiment, the base comprises a base frame enclosing the playing surface, the base frame comprising a front member, a rear member and pair of side members, wherein the base frame members comprise a plurality of removably interconnected sub-members.

According to a preferred feature of the invention, a lower rearward portion of the membrane extends beneath the base.

According to a preferred feature of the invention, the closed end comprises an end element adapted to receive and support the membrane at the closed end.

According to a preferred embodiment, the end element comprises a cup-like element, and wherein the membrane is supported by the side of the cup-like element.

According to a preferred embodiment, the cup-like element comprises a deformable material adapted to absorb kinetic energy from a golf ball impacting the cuplike element.

According to a preferred embodiment, the cup-like element is formed of a leather material.

According to a preferred embodiment, energy-absorbing material is associated with the end element.

According to a preferred embodiment, the energy-absorbing material is situated within a space enclosed by the cup like element and a deformable membrane adapted to be struck by the ball.

According to a preferred embodiment, the energy-absorbing material comprises high-density, low-recoil foam pellets.

According to a preferred embodiment, the cup-like element further comprises apertures adapted to permit the release of air from the space enclosed by the cup like element and the deformable membrane.

According to a further aspect, the invention also resides in a device for practicing ball sports comprising an enclosure defined by a membrane supported from a self-supporting structure, said structure comprising a base having a playing surface and having a forward edge and a support means spaced forwardly and upwardly of the base and supported at least in part from the base, said structure further comprising an upstanding frame supported from the sides of the base and extending over the base and having an uppermost point, said enclosure being supported from said structure to define a space having an open end and a closed end, said space being of a general conical configuration, said open end being supported from the base to maintain said open end in an open condition adjacent the forward edge and the closed end being supported from the support means in spaced relation to the open end, wherein the lower portion of the enclosure is inclined downwardly from the closed end to the base to enable a ball thereon to return to the playing surface end wherein the enclosure extends to each side of the base to provide lateral panels to each side of the base rearwardly of the forward edge of the base, the open end having an upper rear edge extending from the rear of the base and being inclined forwardly from the rear of the base to pass adjacent the uppermost point of the upstanding frame, wherein the open end is defined by a first resiliently flexible elongate member received in the upper rear edge of the membrane and resiliently deformed to define the open end, and wherein the open end of the enclosure is further defined by a portion which underlies the base and which extends between the sides thereof.

According to a preferred feature of the invention, the enclosure has the general shape of a cylinder wherein one end of the cylinder accommodates the first and second elongate elements and the other end is gathered to provide the closed end.

According to a preferred feature of the invention, the portion which underlies the base comprises a second resiliently flexible elongate member received in an edge of the membrane and fixed at its ends to the sides of the base and said second elongate member being resiliently bent to an arcuate configuration extending rearwardly away from the forward edge.

The invention will now be more fully understood in light of the following description of specific embodiments.

BRIEF DESCRIPTION OF THE DRAWINGS

The description is made with reference to the accompanying drawings of which:

FIG. 13*b* is a plan view of the central sub-member shown in FIG. 13*a;*

FIG. 13*c* is an isometric view of the central sub-member shown in FIG. 13*a;*

FIG. 13*d* is an alternative isometric view of the central sub-member of FIG. 13*a;*

FIG. 13*e* is a sectional view of the central sub-member shown in FIG. 13*a* along section line B—B;

DETAILED DESCRIPTION OF SPECIFIC EMBODIMENTS

Figure 1:
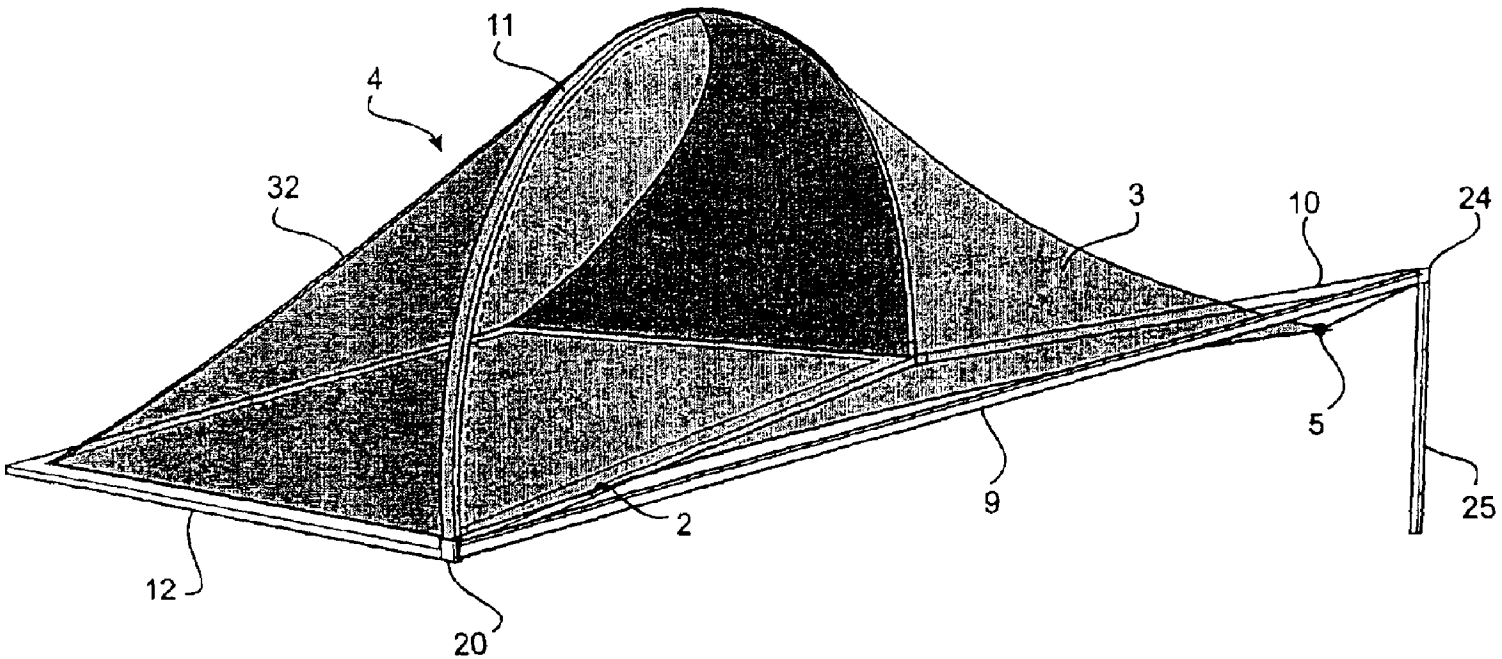
FIG. 1 is a front perspective view of a device for practising golf in accordance with the first embodiment.
Figure 2:
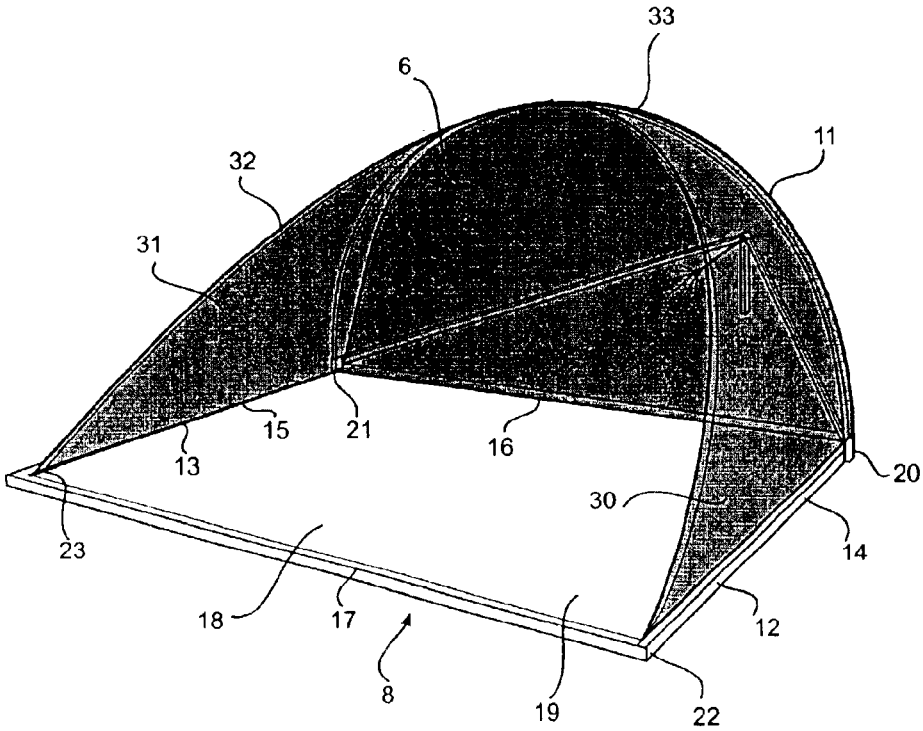
FIG. 2 is a rear perspective view of the device for practising golf as shown in FIG. 1.
Figure 3:
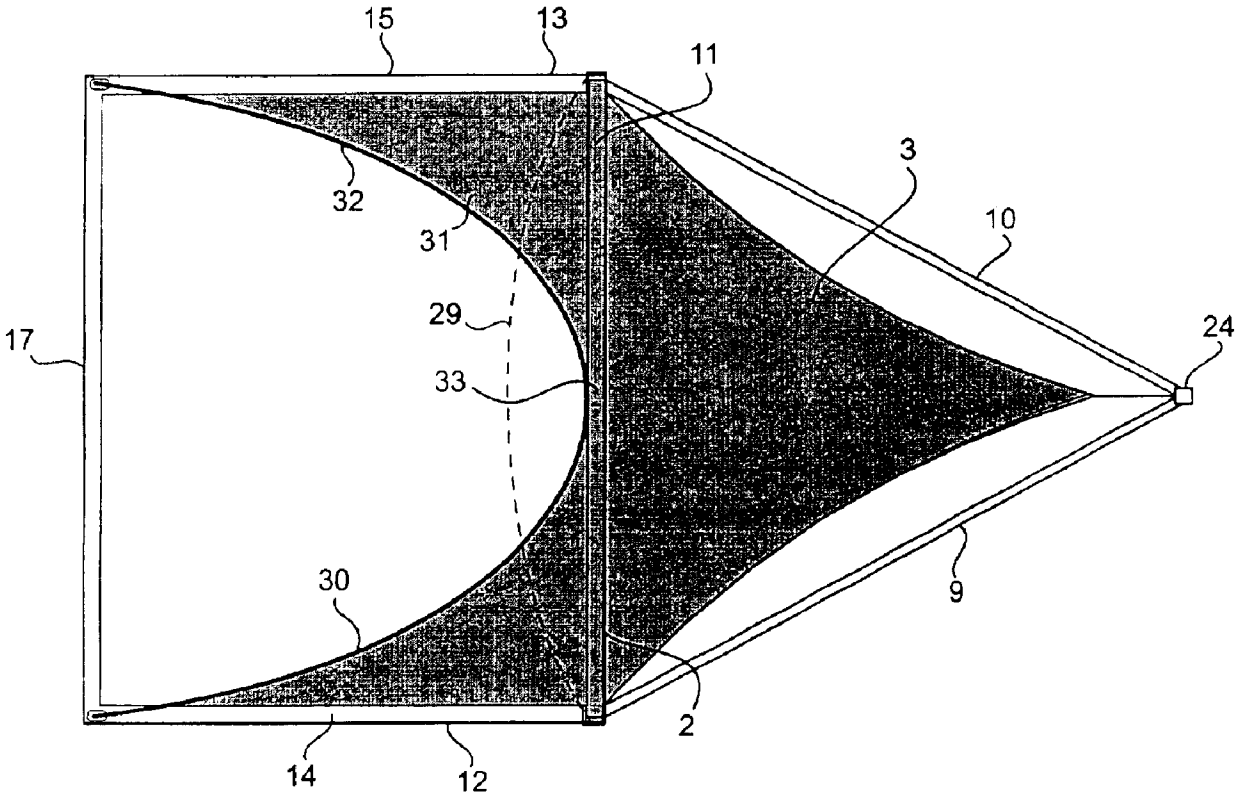
FIG. 3 is a plan view of the device for practising golf as shown in FIG. 1.
Figure 4:
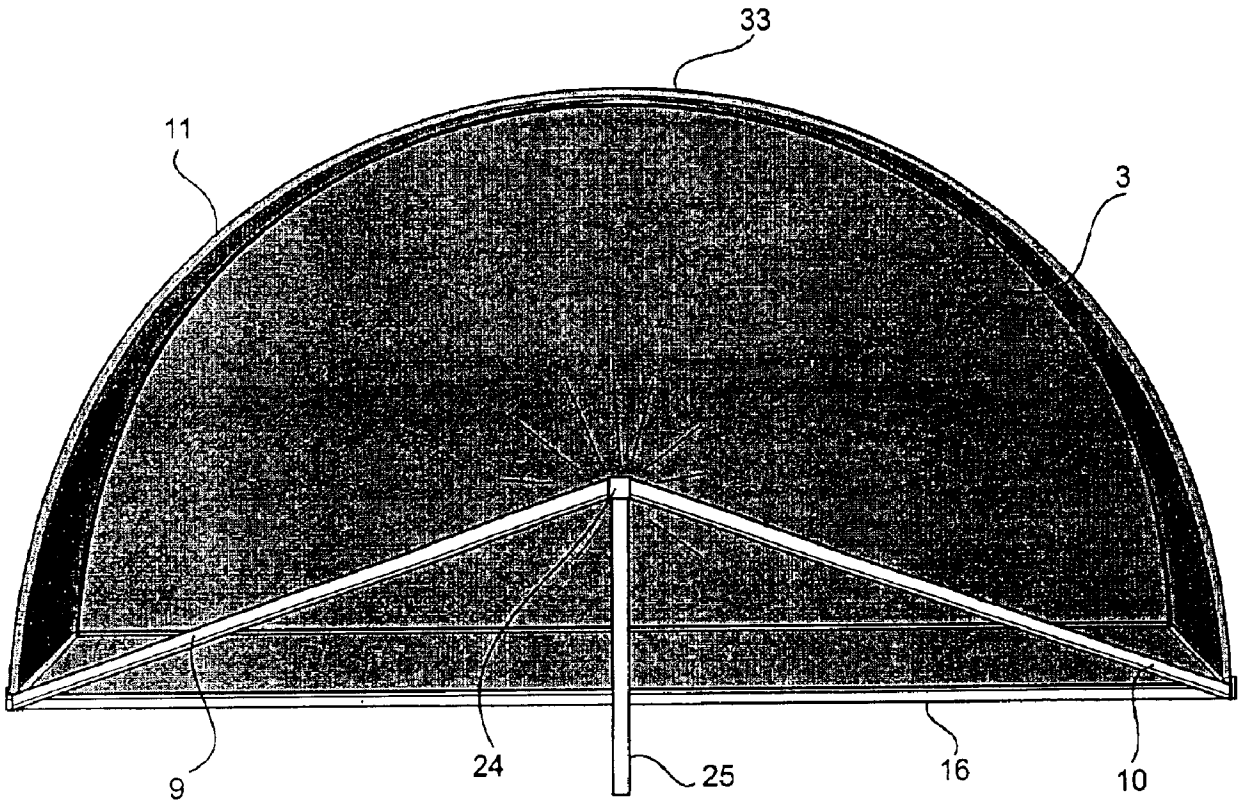
FIG. 4 is a front view of the device for practising golf as shown in FIG. 1.

The embodiments will be described with reference to golf balls being struck by a golfer using the full range of clubs including metal woods, woods, other driver clubs, including fairway woods, irons etc.

It is a feature of the embodiments that the apparatus may be erected on any suitable supporting surface such as reasonably flat ground or on the floor of a room. It is a further feature of the embodiments that the apparatus is free standing and requires no structural support such as being tied to pegs in the ground or to a support column other than the separate free standing net support described as part of some of the embodiments.

The first embodiment as shown in FIGS. 1 to 9 comprises an enclosure 3 for catching a ball (not shown) having a membrane in the form of a net having an open end 4 and a closed end 5 thereby defining a space 6 into which a ball may be projected. The enclosure 3 is supported from a self-supporting structure which comprises a base 8 with a front edge 2, a pair of support struts 9 and 10 extending forwardly of the base 8 and converging to be connected at their forwardmost ends by a junction element 24. The structure further comprises an upstanding frame 11 supported from the sides 12 and 13 of the base 8.

The base 8 of the structure comprises a rectangular base frame defined by side members 14 and 15, a front member 16 defining the front edge 2 and a rear member 17. The members are fixed at their ends by two rear corner elements 22 and 23 and two front corner elements 20 and 21. The four members may be of any convenient material such as wood, plastics material or metal. To enhance portability, each member may be constructed from two or more sub-members joined together by joining elements (not shown). Thus when the structure is disassembled for transportation, the length of each sub-member will not exceed a length that may be conveniently carried in a car.

A panel 18 formed of a suitable resilient material such as rubber is received within the area enclosed by the base frame. The upper surface 19 of the panel defines the playing surface upon which a ball can be placed to be struck by the player into space 6. To enhance the feel and appearance of the playing surface, a covering such as artificial grass, outdoor or indoor carpet or matting is provided. The thickness of the panel and covering is substantially the same as the thickness of the base frame members to ensure that a ball does not encounter a bump or ridge when being struck or when returning to the user.

Figure 6:
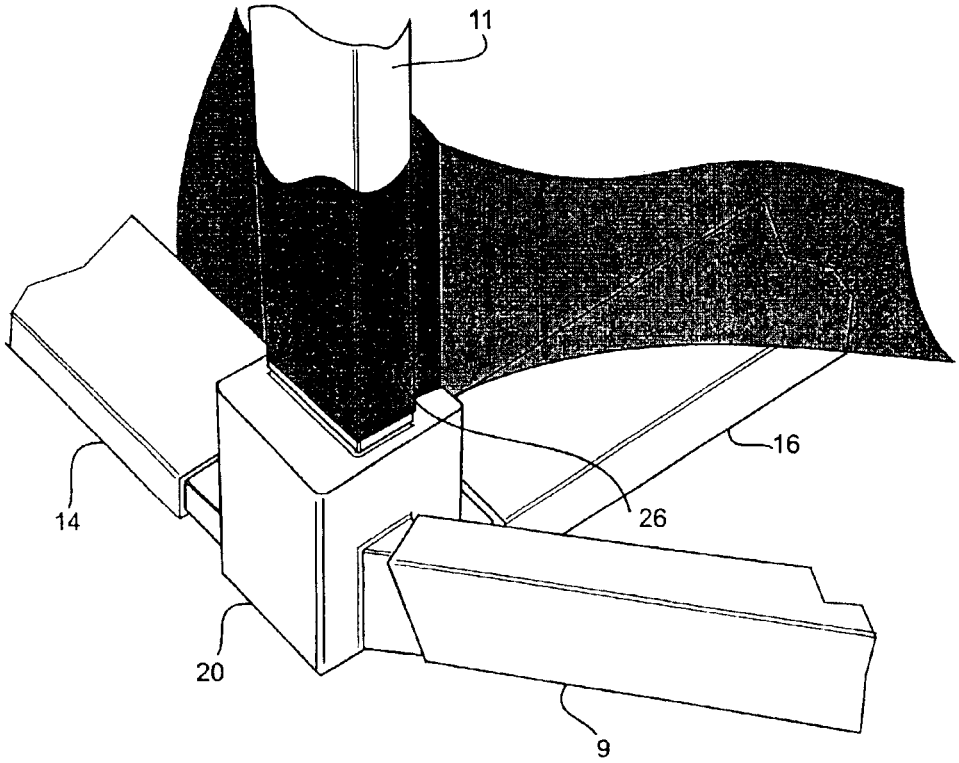
FIG. 6 is an expanded view of a front corner element of the base of the device for practising golf as shown in FIG. 1.

As shown in FIG. 6, the two front corner elements 20 and 21 at each end of the front member 16 are also adapted to disconnectably support the upstanding frame 11. The upstanding frame 11 is of rigid material such as wood, plastics material or metal and extends above the front base frame member. A substantially semi-circular shape is selected so as to conform to the shape of the netting. The frame can be constructed from two or more sub-members disconnectably joined together by joining elements, to provide a structure that is easily transportable and where all elements will fit within a car.

Also as shown on FIG. 6, the two front corner elements 20 and 21 at each end of the front member 16 are further adapted to engage the rear ends of the support struts 9 and 10 which extend forward of the base 8. The support struts 9 and 10 are rigid elements formed of convenient material such as wood, plastics material or metal. As stated, the forward ends of the support struts are connected by a junction element 24 to form an apex. The apex is supported above the surface upon which the structure is located by a rigid upstanding frame element 25. Again, each support strut can be constructed from two or more sub-members disconnectably joined together by joining elements, to provide a structure that is easily transportable and where all elements will fit within a car.

The net 12 may be formed from any suitable material but netting of Rachell Knotless Knitted type has been found to be particularly suitable. Nylon is the preferred cord material for forming the netting due to its strength and durability. However, other, less expensive materials, including polyester, polypropylene or polyethylene may also be used. However, nylon is preferred due to its superior strength which therefore provides the least weight per unit of area of netting material. It is also more pliable which enables the net to adopt the desired enclosure shape more readily and with lower tension applied. The netting mesh size is determined to be as large as practicable while still being capable of preventing the passage of the ball through the netting. The size selected will also depend upon the netting material chosen and its thickness. A net produced from nylon of 3 mm thickness with a mesh size of 16 mm×16 mm is considered optimum to stop a golf ball, although these parameters may be modified depending on the circumstances.

The net 12 is manufactured in cylindrical form wherein a one end provides the open end and the other end provides the closed end.

The enclosure 3 is supported at the open end 4 by the upstanding frame 11. The open end 4 also extends beyond the upstanding frame 11 and is further supported by an arcuate tube at a rear edge of the enclosure. The closed end 5 is supported by connection to the junction 24 of the support struts 9 and 10. The closed end 5 is created by circumferentially binding the enclosure 3 adjacent the closed end 5. A disc or cup (not shown) of plastics material is secured at the closed end to prevent a ball from becoming jammed at the closed end 4 and also to reduce wear at that area.

A support hem 26 is provided in the enclosure 3 adjacent the upstanding frame 11. The upstanding frame 11 supports the enclosure 3 by being inserted into the support hem 26.

The enclosure 3 extends to each side 12 and 13 of the base 8 to provide lateral panels 30 and 31 to each side 12 and 13 of the base 8 rearwardly of the front member 16 of the base 8. The upper rear edge 32 of the open end 4 of the enclosure 3 is of a general arcuate configuration, extending from the rear corners 22 and 23 of the base 8 and being inclined forwardly from the ends to pass adjacent the uppermost point 33 of the upstanding frame 11. Thus, the portion of the enclosure between the open end 4 and the upstanding frame 11 provides the lateral panels 30 and 31. The upper rear edge 32 is provided with a hem (not shown) into which is inserted a resiliently flexible tube. Due to its resilience, when inserted into the arcuate hem, the tube biases the upper rear edge 32 outwardly or in a sidewards direction so that the lateral panels 30 and 31 do not interfere with the golfer's swing. The tube accommodates a filament which extends through the elongate member and which is fixed at either end to the base 8.

Figure 7:
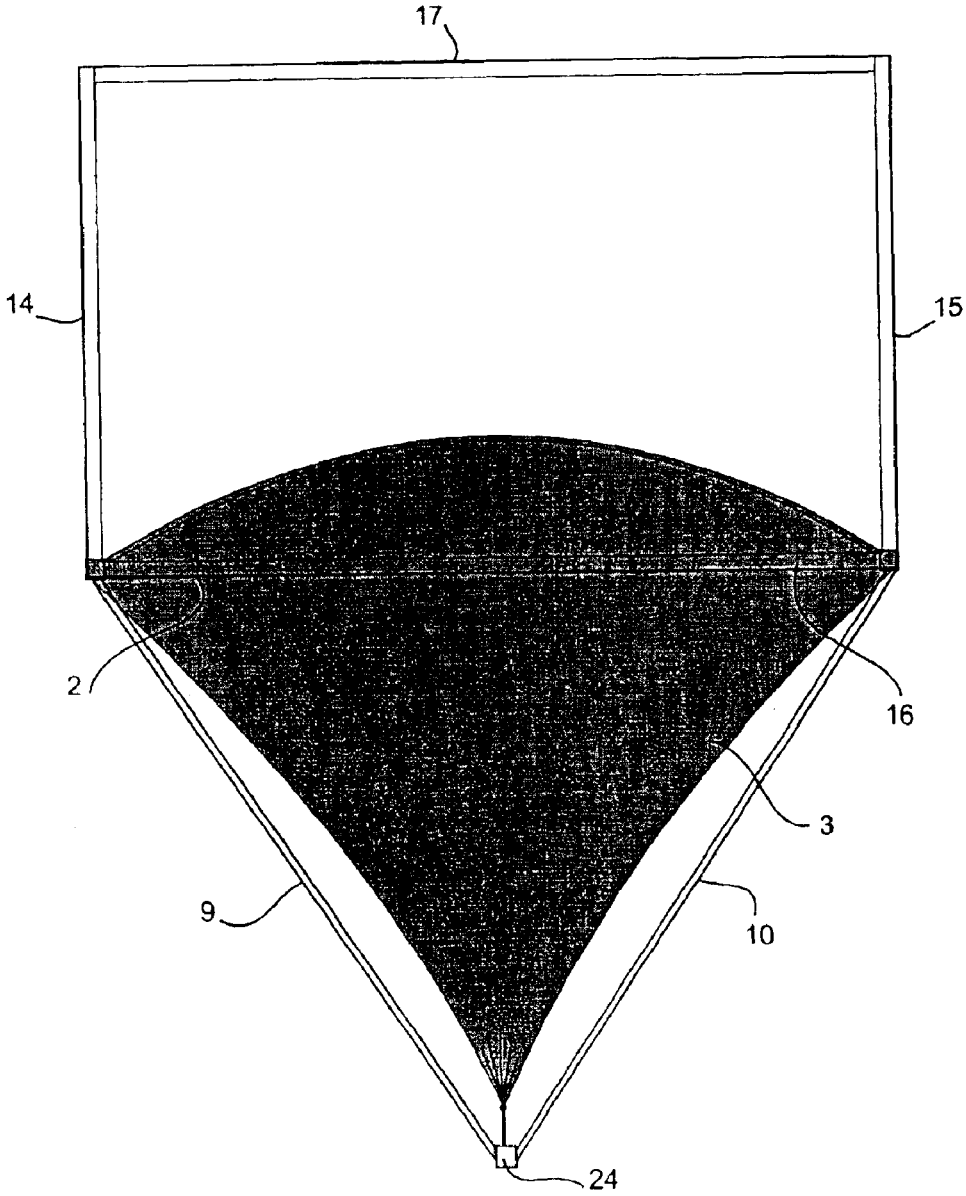
FIG. 7 is a plan view of the base of a device for practising golf as shown in FIG. 1 with the base panel removed.
Figure 8:
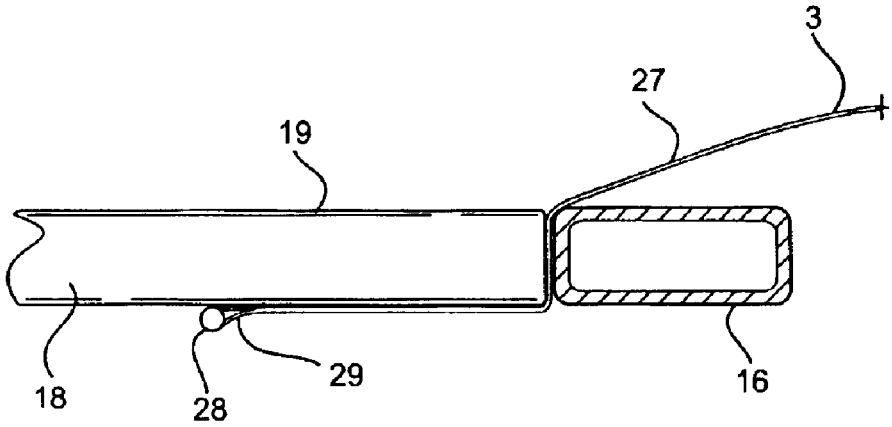
FIG. 8 is a sectional view through the front of the base of a device for practising golf as shown in FIG. 1.

As shown in FIG. 8, the open end 4 of the enclosure is also provided with a lower portion 27 which extends over the base frame front member 16 and underlies the base panel 18. This lower portion 27 extends between the sides 12 and 13 of the base and is supported by a flexible resilient rod 28 received in a hem 29 at the edge of the lower portion 27. As shown in FIG. 7, the rod 28 is bent into an arc extending rearwardly away from the front member 16 and is fixed at each end to the side members 14 and 15 of the base 8 at the front corner elements 20 and 21. This novel restraining method mechanism displays two advantages. As shown in FIG. 8, by passing the enclosure portion above the front member of the base frame, the presence of a lip or bump in the path of a ball returning to the playing surface 19 is avoided. Further, by bending the rod 28 into an arc, the enclosure 3 is better able to adopt its natural shape about the rod 28 when it is tensioned.

In an alternative adaptation of the embodiment, the enclosure is supported adjacent the rear corners elements 22 and 23 of the base so that the lower portion 27 underlies the base.

Figure 9:
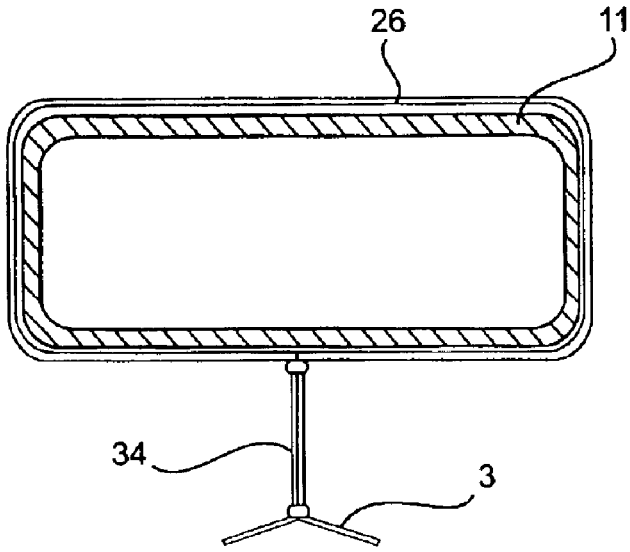
FIG. 9 is a sectional view through an upstanding frame member of a device for practising golf as shown in FIG. 1
Figure 10:
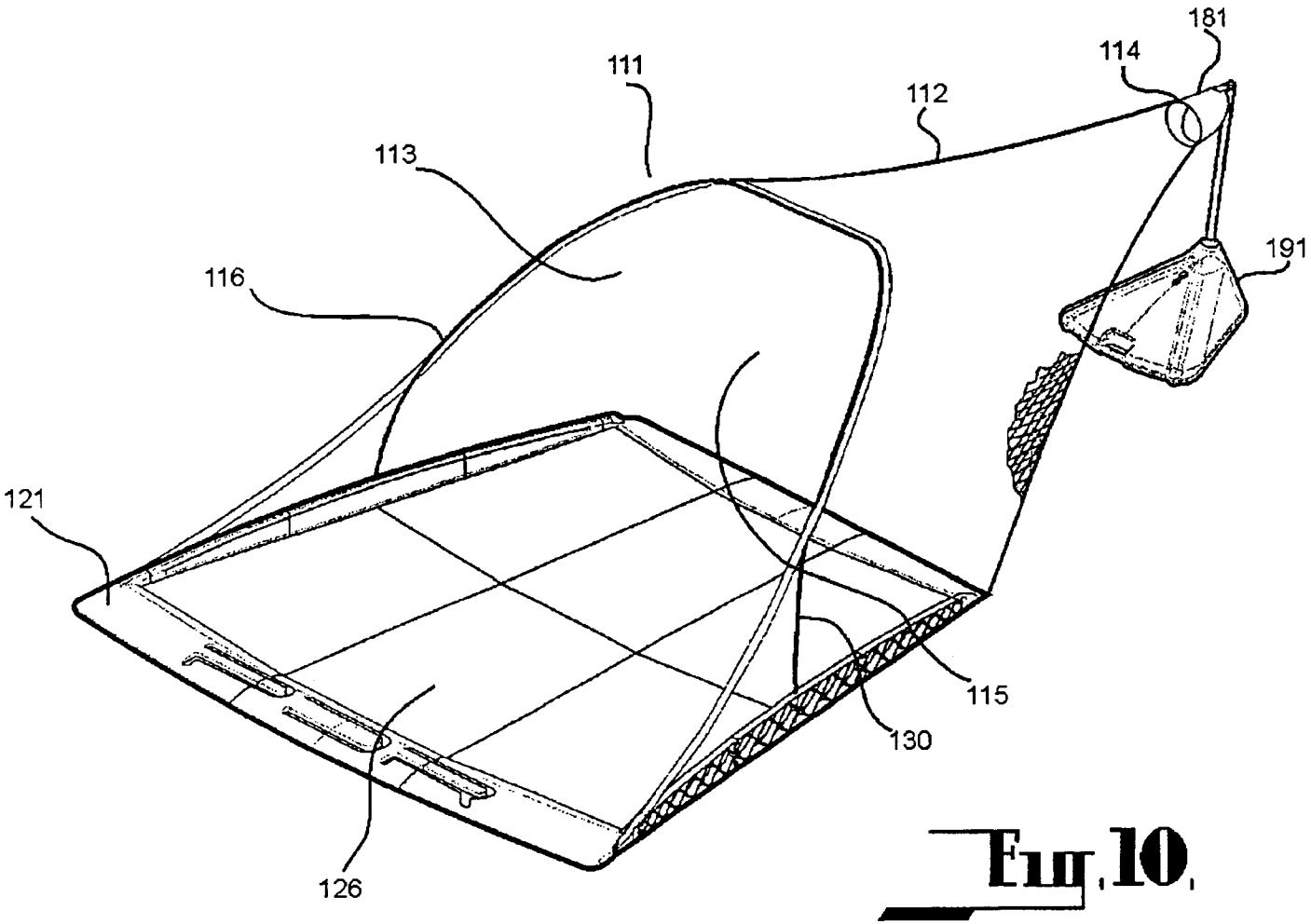
FIG. 10 is an isometric view of the third embodiment when erected.

A further feature of the embodiment resides in the way in which the enclosure 3 is extended rearwardly of the upstanding frame. As shown in FIG. 9, the enclosure membrane 3 is supported by the support hem 26 via a support webbing 34 to hold the enclosure membrane clear of the upstanding frame member 11. As a result, the upstanding frame member 11 cannot be directly struck by a mis-hit ball, thus avoiding or at least reducing the risk of such a ball rebounding adversely towards the user.

As a result of this novel manner of providing the lateral panels 30 and 31, the height of the upstanding frame above the support surface on which the device is located can be restricted to less than the height of an average player while the lateral panels 30 and 31 provide a semi-canopy over the base area which will capture almost any possible mis-hit ball and yet which does not interfere with the club of the golfer during the golf swing. This enables the device to be sufficiently small to be used in normal domestic rooms, while providing the safety necessary for such use.

Figure 5:
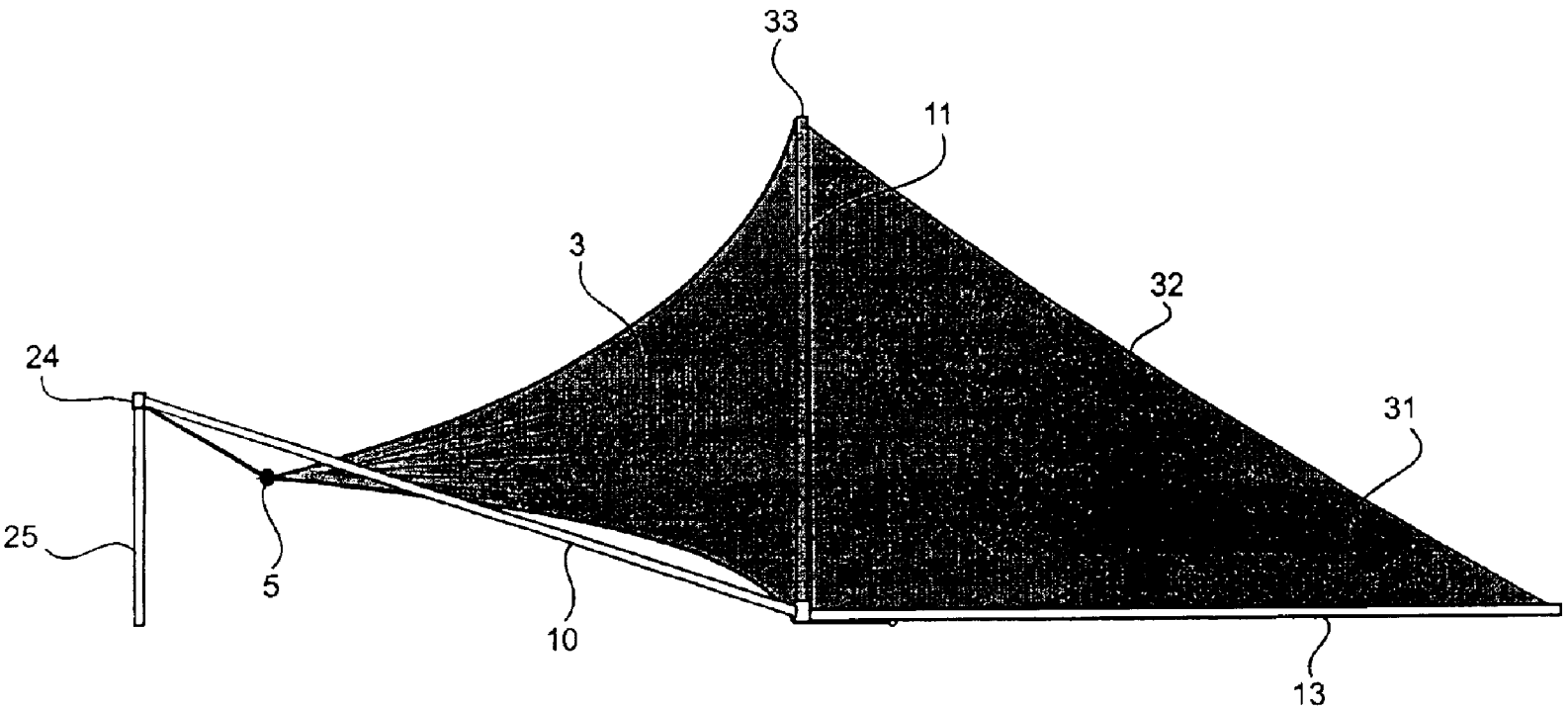
FIG. 5 is a side view of the device for practising golf as shown in FIG. 1.

The closed end of the enclosure 3 is secured to the junction of the support struts under tension to give it its shape and create the space into which the ball is struck. While certain prior art devices have disclosed an enclosure having a frusto-conical shape obtained by stretching the net under considerable tension, it has been found advantageous to erect the enclosure 3 under reduced tension so that it adopts a form akin to that of a trumpet horn, as shown in FIG. 5. In that shape, the enclosure 3 is not unduly taut so that, on impact of the ball upon the enclosure membrane, the adjacent area of membrane can be displaced substantially transversely to the surface of the enclosure. This displacement allows the enclosure to absorb the kinetic energy of the ball without imparting substantial rebound velocity or causing damage to the membrane, as can be the case if the material is held very taut.

In use, a user who wishes to practice their golf shots places a ball on the playing surface on the base 8. The user then aims the ball towards the open end 4 of the enclosure 3. The ball once struck will move towards the closed end 5 either directly or indirectly by deflecting from the enclosure towards the closed end 5. The ball loses it energy due to the impact with the surrounding wall and will return to the feet of the user since the substantially trumpet shape biases the slope such that the ball will return to substantially the same position on the playing surface 19 as the ball was initially struck.

According to a second embodiment, the upstanding frame is formed from a resilient rod which can be bent such that the ends are located in the front corner elements.

A third embodiment is shown in FIGS. 10 to 19. The apparatus of the third embodiment comprises an enclosure 111 for catching a ball (not shown) having a membrane in the form of a net 112 having an open end 113 and a closed end 114 thereby defining a space 115 into which a ball may be projected. The net 112 is adapted to be supported at its open end 113 from a first self supporting structure 120 which comprises a base 121 and flexible resilient elongate frame element 130, as better shown in FIG. 11.

The base 121 of the structure 120 comprises a base frame in which there is located a playing surface 126, the base frame defined by side members 122 and 123, a rear member 124 and a front member 125.

It has been found that it is advantageous for the outline of the base to be of substantially trapezoidal in form, having the two sides 122 and 123 converging from the rear to the front, as seen in the plan view. In this way the base is adapted to better cooperate with the net which is substantially conical in form when in use. A portion of the net is laid beneath the base and it has been found that a converging base form sits over the net in a way that avoids bunching and/or stretching of the net in localised areas. This configuration enables the net to be constructed from simple cylindrical netting thereby avoiding difficult and expensive net construction. The net 113 is of cylindrical or tubular construction, a construction method well known to those skilled in the art, having an edge transverse to the cylinder axis at one end to comprise the closed end and an edge formed obliquely to the cylinder axis at the other end to provide the open end.

Figure 12:
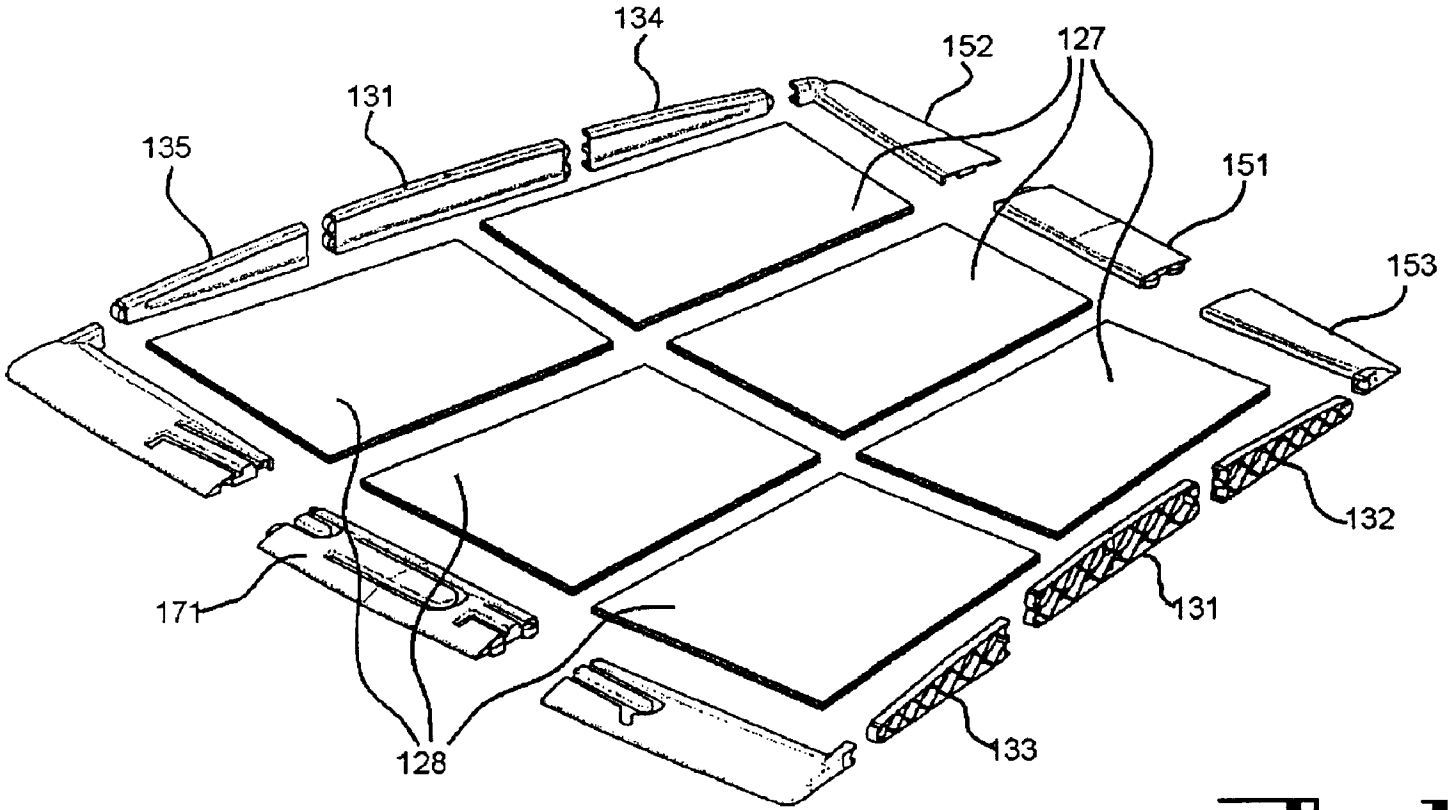
FIG. 12 is an exploded view of the base of the third embodiment.
Figure 13A:
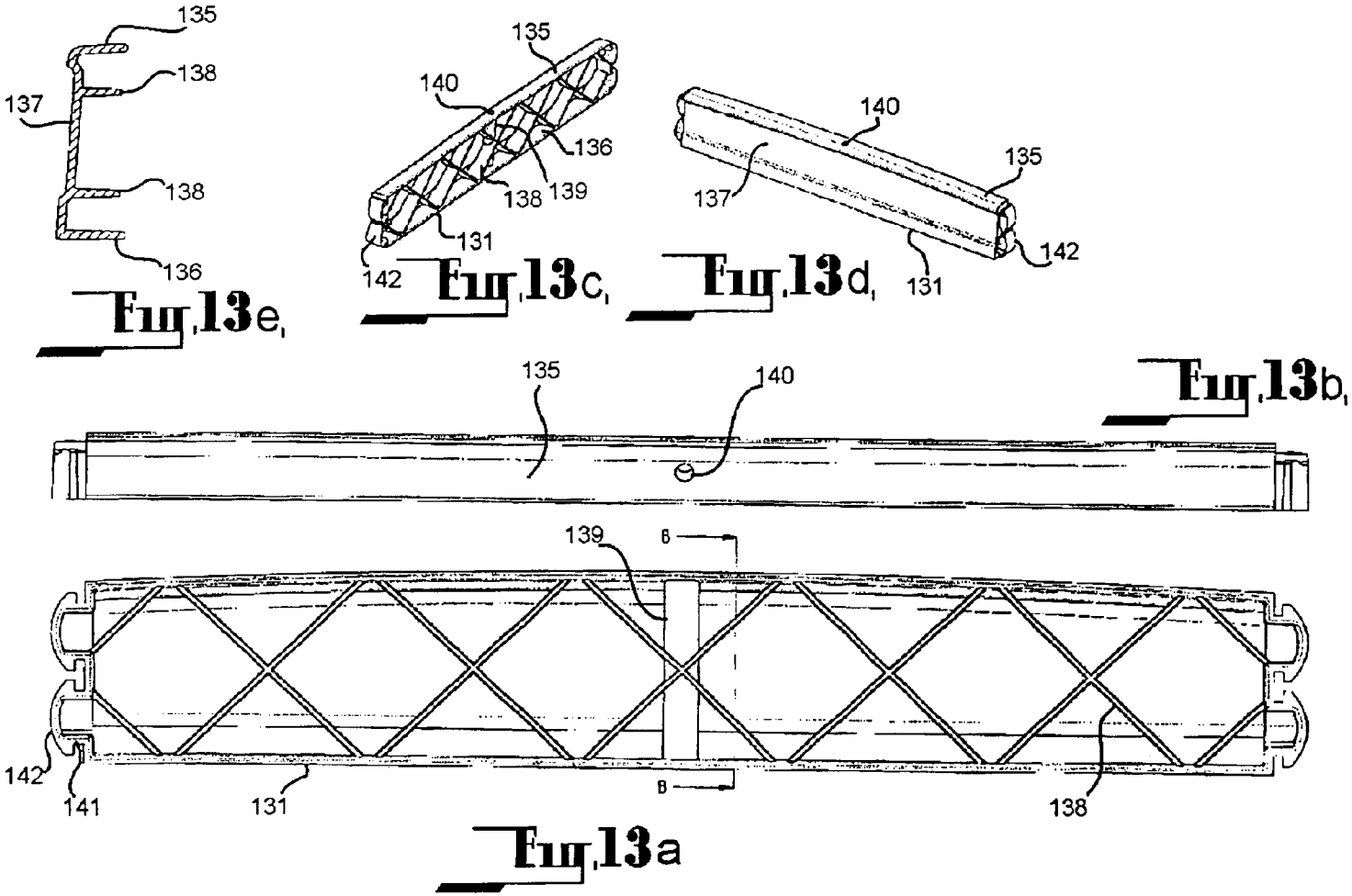
FIG. 13*a* is a side elevation of a central sub-member of a side member according to the third embodiment.

As shown in the exploded diagram of FIG. 12, the playing surface 126 is defined by a first group of three, identically shaped mats 127, each of symmetrical trapezoidal shape, and a second group of three, identically shaped mats 128 each of symmetrical trapezoidal shape. The length of the non-parallel sides of the mats of the second group is the same as the length of the non-parallel sides of the first group, while the length of the shorter parallel side of mats of the second group is equal to the length of the longer side of the mats of the first group. In use, the mats are arranged on the supporting surface to provide the playing surface 126 in three columns of two mats side by side, each column being of symmetrical trapezoidal shape. The playing surface thereby is provided with two straight sides and a front end comprising three, equal-length segments and a rear end comprising three, equal-length segments.

Each mat comprises a support base with an upper surface suitable for practising the striking of a golf ball with a golf club. Synthetic lawn has been found to be very suitable although even good carpet has proved to be adequate for general practice. Indeed it is possible for the rear mats, only to be of a type suitable for striking the ball as a player would generally find he is too close to the net if he strikes from the forward mats.

Figure 11:
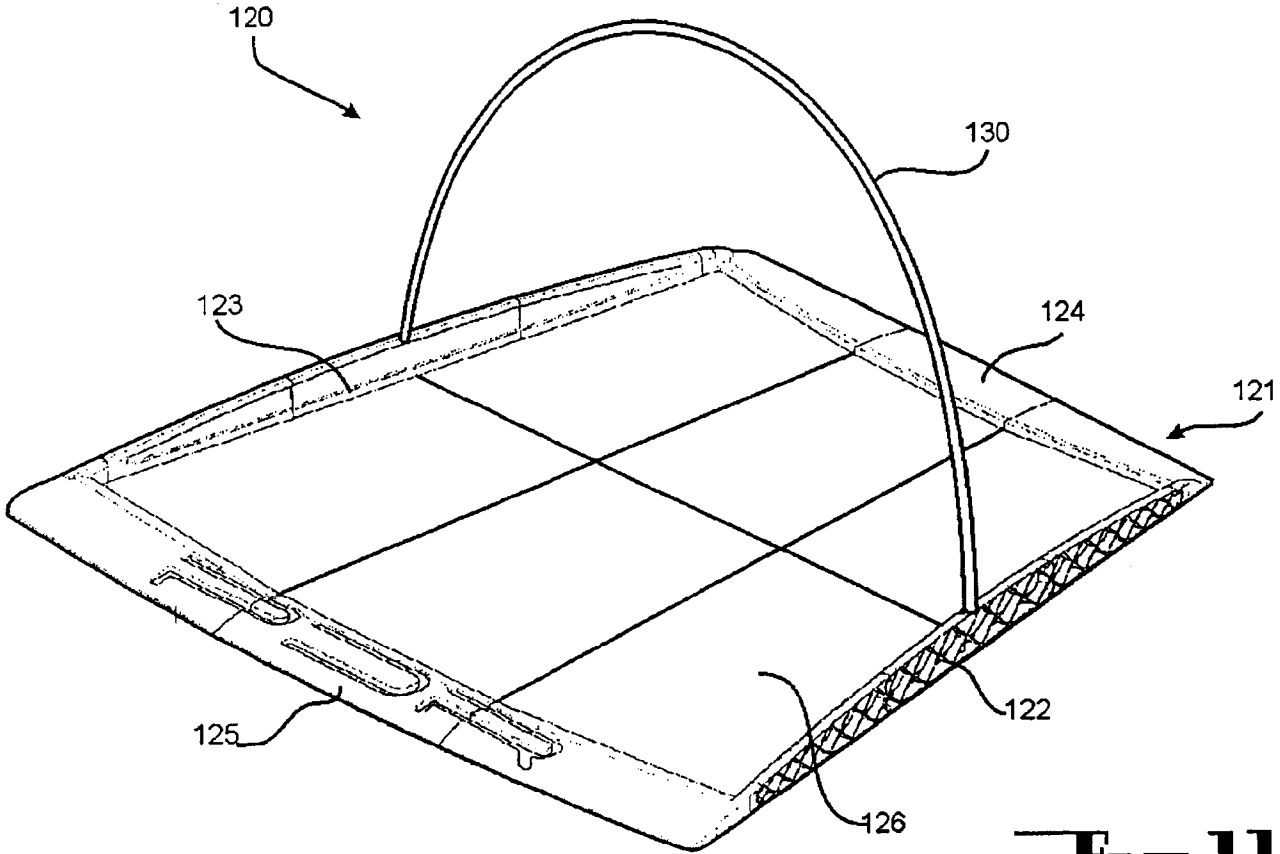
FIG. 11 is an isometric view of the base of the third embodiment.

As shown in FIG. 11, the base frame, when assembled, provides a perimeter surrounding and abuttingly conforming to the assembled playing surface 126.

In order to enhance portability, the side member 122 and 123, the front member 124 and the rear member 125 each comprise three sub-members.

The side member 122 comprises a central sub-member 131, a forward sub-member 132 and a rearward sub-member 133, while the side member 123 comprises a central sub-member 131, a forward sub-member 134 and a rearward sub-member 135.

As shown in FIGS. 13*a* to *e*, each central sub-member 131 comprises an integrally moulded, substantially channelled-section member having an upper flange 135 joined to a lower flange 136 by a web 137. The lower flange 136 is planar and adapted to sit on a flat surface, while the upper flange 135 is arcuate as seen from the side view. The web 137 is inwardly indented at a position spaced from the upper and lower channel to provide additional stiffness. The central sub-member 131 is provided with a lattice of reinforcing ribs 138 extending the length of the sub-member within the channel portion. Centrally located along the length, of the central sub-member 131 there is provided a laterally disposed tube portion 139 extending from the upper flange 135 to the lower flange 136, and attached to the web 137 for strength. The tube portion 139 is aligned with an aperture 140 in the upper flange 135 and adapted to receive an end of the frame element 130.

At each end of the central sub-member 131, there is provided a pair of male connecting means adapted to enable connection with the adjacent end sub-members 132 and 133 or 134 and 135, respectively. In the embodiment, each connecting means comprises a leg portion 141 extending from the respective end of the central sub-member 131 and terminating in a retaining head 142 overlying the leg portion 141.

Figures 14A, 14B, 14C, 14D, 14E, 14F:
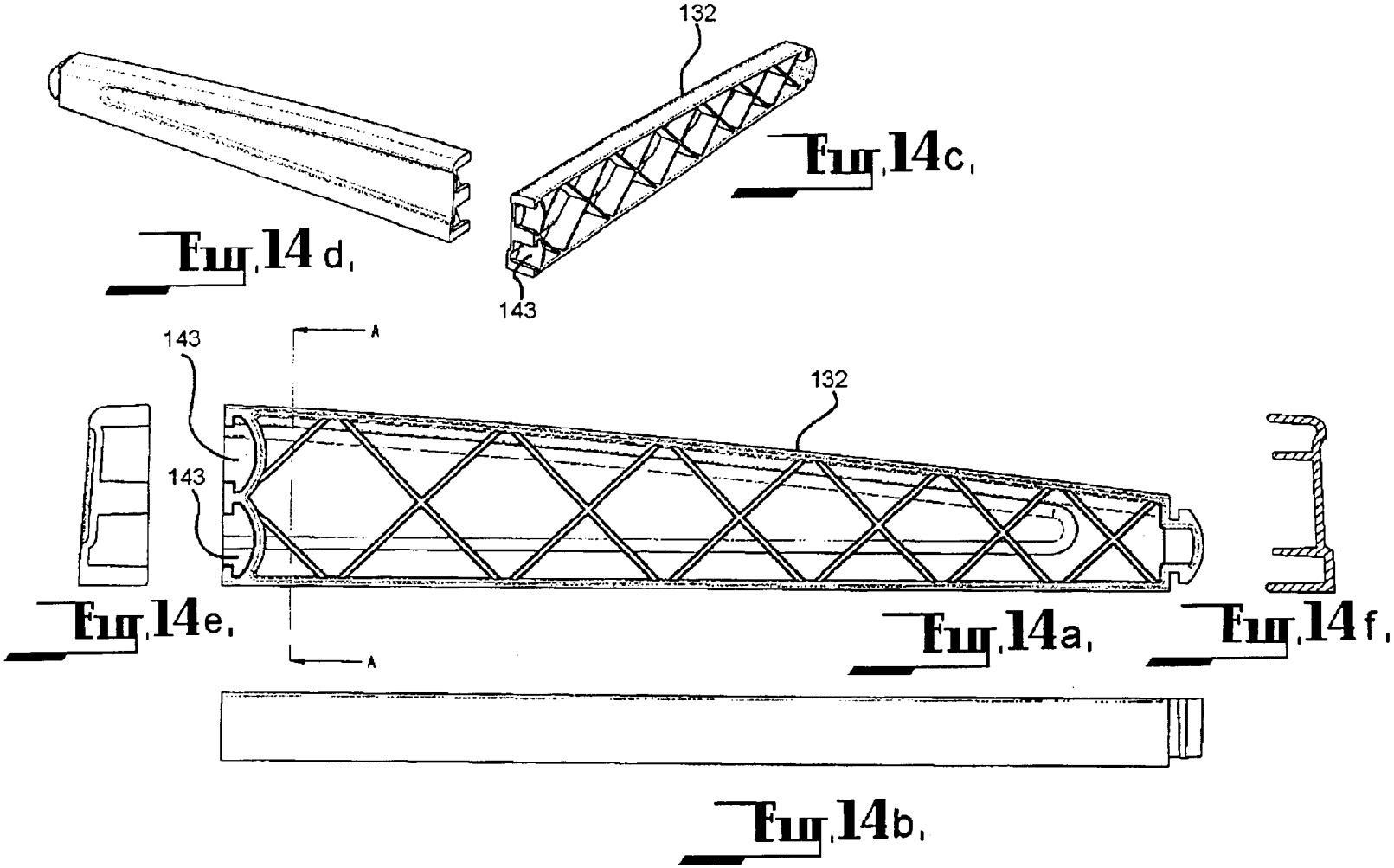
FIG. 14*a* is a side elevation of an end sub-member of a side member according to the third embodiment.
FIG. 14*b* is a plan view of the end sub-member shown in FIG. 14*a;*
FIG. 14*c* is an isometric view of the end sub-member shown in FIG. 14*a;*
FIG. 14*d* is an alternative isometric view of the end sub-member shown in FIG. 14*a;*
FIG. 14*e* is an end view of the end sub-member shown in FIG. 14*a;*
FIG. 14*f* is a sectional view of the end sub-member shown in FIG. 14*a* along section line A—A.

FIGS. 14*a* to *f* depict a sub-member suitable for use as sub-member 132 or 135. It should be understood that sub-members 133 and 134 are of the mirror image construction and are not separately described. The sub-members are generally of the same manner of construction as the central sub-member 131, having a substantially channel section with lattice reinforcement. At the end of each of the sub-members adjoining the central sub-member 131 there is provided female engaging means in the form of two apertures 143, each shaped with a profile corresponding with the outline of the male connecting means of the central sub-member 131 and adapted to engagingly receive the respective male connecting means. At the end of each of the sub-members remote from the central sub-member 131 there is provided connecting means in the form of a single male member 142 of corresponding design to those provided on the central sub-member when viewed from the side elevation as shown in FIG. 14*a*. Each upper flange of the forward and rearward sub-members is arcuate when viewed from the side elevation as shown in FIG. 14*a*. Due to the arcuate profile of the upper flange of the forward and rearward sub-members, the height of the side members reduces towards the end remote from the central sub-member 131.

The front member 124 comprises a middle sub-member 151, a left sub-member 152 and a right sub-member 153. FIGS. 15*a* to *g* depict the middle sub-member 151. Each sub-member comprises a moulding from plastics material having a regular upper surface 161 extending from a transverse lip 162 at the inner edge to the outer edge. The inner edge of each sub-member has a height corresponding with the thickness of the mats of the playing surface. The profile of the upper surface 161 is arcuate so that, when the sub-member is placed on a planar surface for use, the upper surface extends substantially to the planar surface at the outer edge. The upper surface 161 is reinforced by a lattice of ribs 164 substantially transverse to the upper surface extending to the plane bounded by the lower edges of the sub-member. Corresponding connection means are provided at the ends of each sub-member for connection with the adjoining sub-member. The left and right sub-members 152 and 153 have connection means suitable for connecting with a corresponding forward side sub-member 132 or 134 respectively on their ends remote from the middle sub-member 151.

The rear member 125 comprises a middle sub-member 171, a left sub-member and a right sub-member. The middle sub-member 171 is shown in FIGS. 16*a* to *g*. The manner of construction of the sub-members of the rearward member 125 is similar to that of the forward member, the profile of bottom surface incorporating a space 173 in order to accommodate the net 112 as discussed below. In addition, the rearward sub-members include identification markings 175 on the upper surface.

As mentioned above, the flexible frame element 130 is adapted to be supported from the sides of the base to form an arch able to support the open end of the net 112. The flexible frame element 130 comprises a rod or tube of substantial strength in order to be able to support the net 112 and may be formed from fibreglass or suitable plastics material such as a medium to high-density polyethylene to provide the relevant level of resilient flexibility. In use, the ends of the flexible frame element 130 are received within the tube portion 139 of each side member through each aperture 140. The exposed portions of the flexible frame element are covered by an energy absorbing material such as a foamed plastics material.

The net 112 is of drooping conical or horn-like configuration when in use, the horn-like shape extending from the closed end to the open end to direct a ball to roll from the closed end to the playing surface.

Figure 17C:
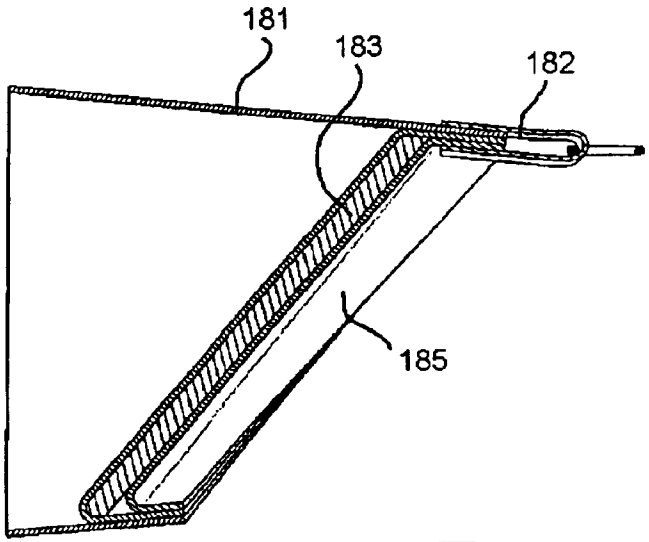
FIG. 17*c* is a sectional view of the cup shown in FIG. 17*a* along section line A—A.
Figure 17A:
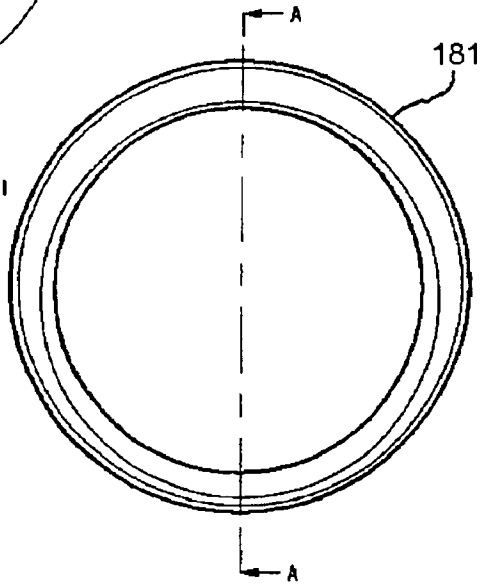
FIG. 17*a* is a rear view of a cup supporting the closed end of the net according to the third embodiment.
Figure 17B:
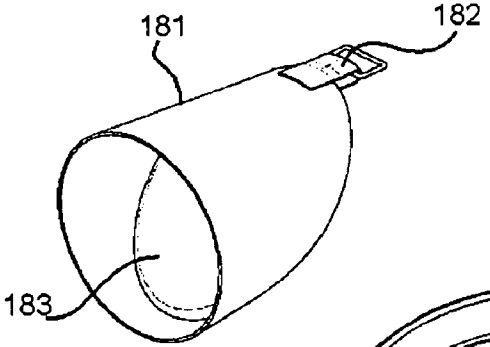
FIG. 17*b* is an isometric view of the cup shown in FIG. 17*a;*

The closed end 114 is created by circumferentially binding the net 112 adjacent the closed end 114 about an end element in the form of a cup 181. The cup 181 is preferably made from leather as this material has been found to provide the required strength and durability together with the appropriate impact absorbing properties to absorb the energy of a ball in the event of a direct hit. The use of the cup 181 also prevents a ball from becoming jammed at the closed end 114 and reduces wear at that area of the net 112. As shown in FIGS. 17*a* to *c*, the cup 181 comprises retaining means 182 adapted to be engaged by suitable supporting means. The cup 181 also incorporates a resilient pad 183 covering the base 185 of the cup 181. The pad 183 is adapted to further absorb the energy of a ball in the event of a direct hit. In addition, the base 185 of the cup 181 is mounted obliquely to the horizontal so that a direct hit is not reflected straight back to the player.

The closed end is supported above the supporting surface by suitable support means to hold the net 112 in extended form. While it may be possible to support the closed end from a neighbouring fixed structure such as a wall or a post extending from the supporting surface, a portable support 191 has been devised to enable the enclosure to be utilised on any supporting surface even where no suitable fixed structure is available.

Figure 18:
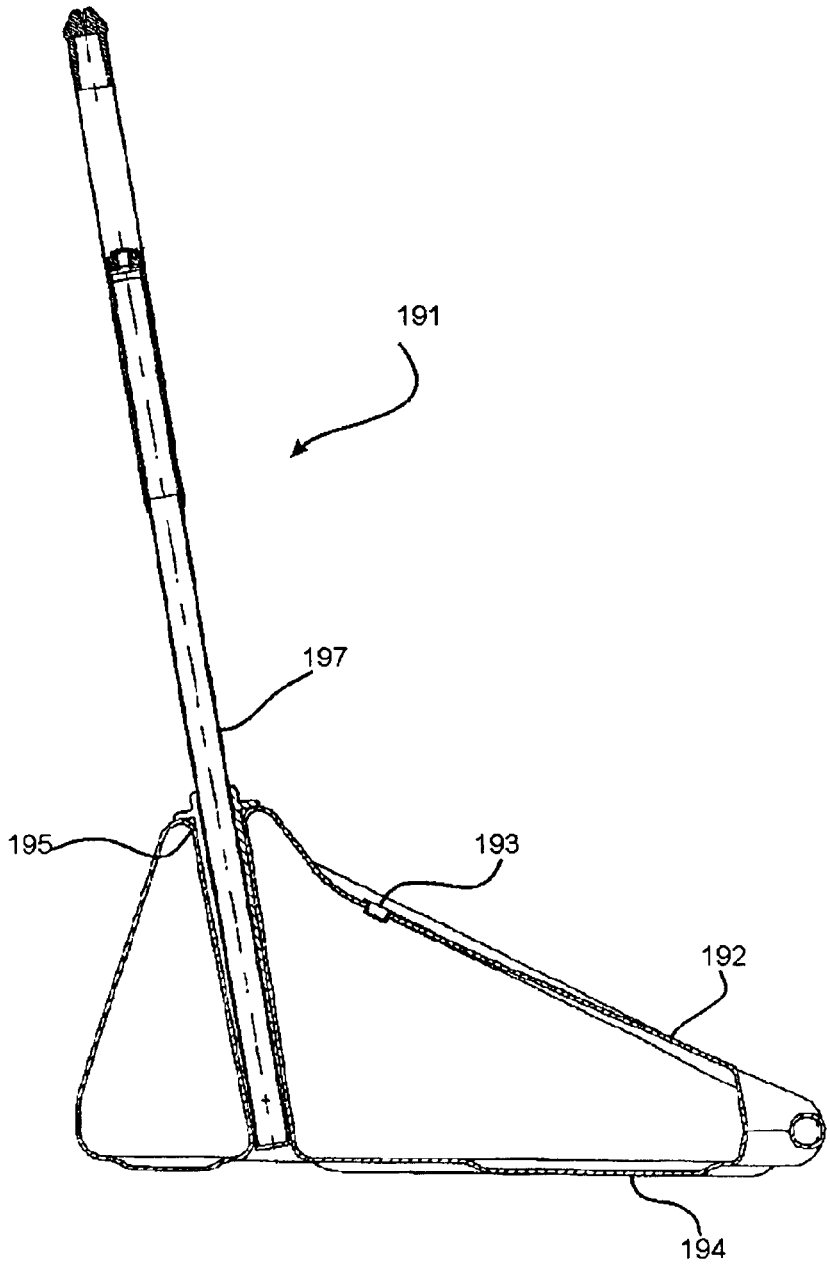
FIG. 18 is a sectional view of a portable support according to the third embodiment.
Figure 19A:
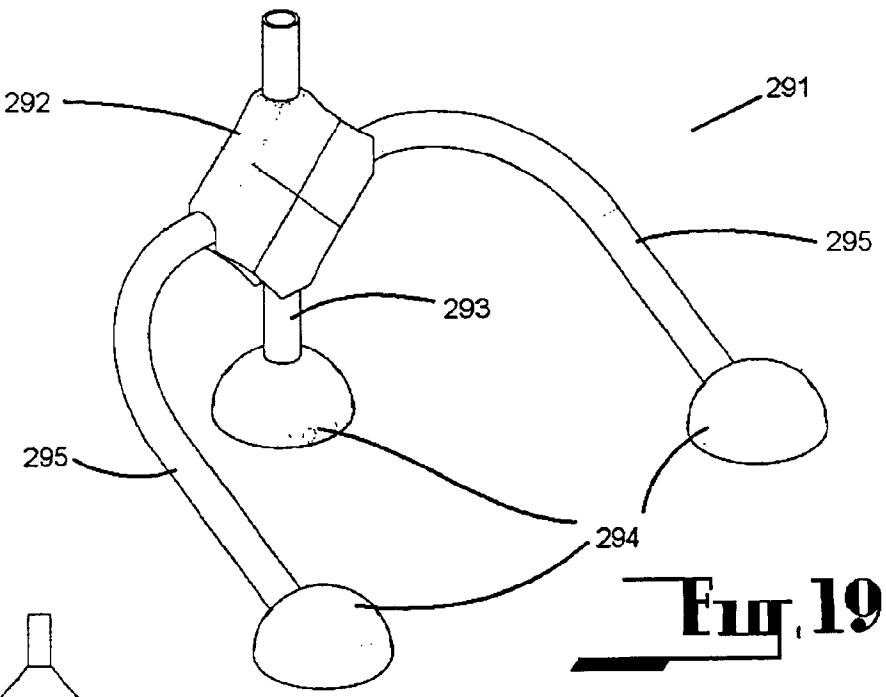
FIG. 19*a* is an isometric view of a portable support according to the fourth embodiment.
Figure 19B:
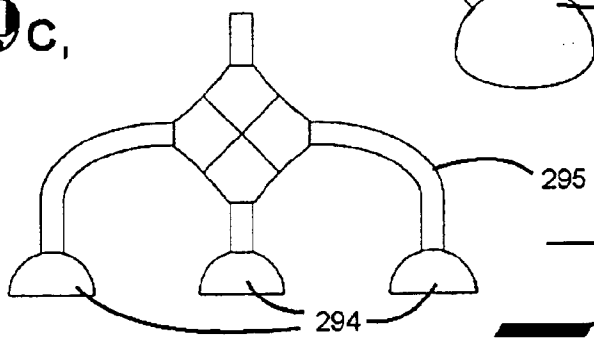
FIG. 19*b* is a front elevation of the portable support shown in FIG. 19*a;*
Figure 19C:
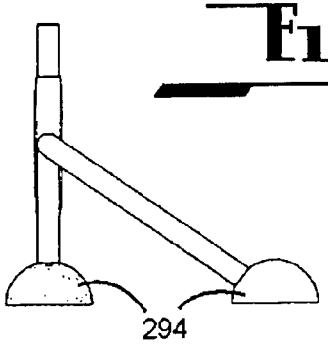
FIG. 19*c* is a side elevation of the portable support shown in FIG. 19*a;*
Figure 19D:
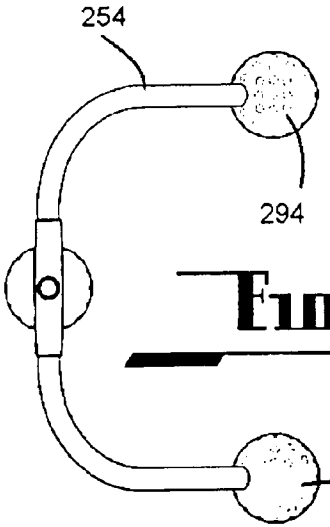
FIG. 19*d* is a plan view of the portable support of FIG. 19*a;*
Figure 20:
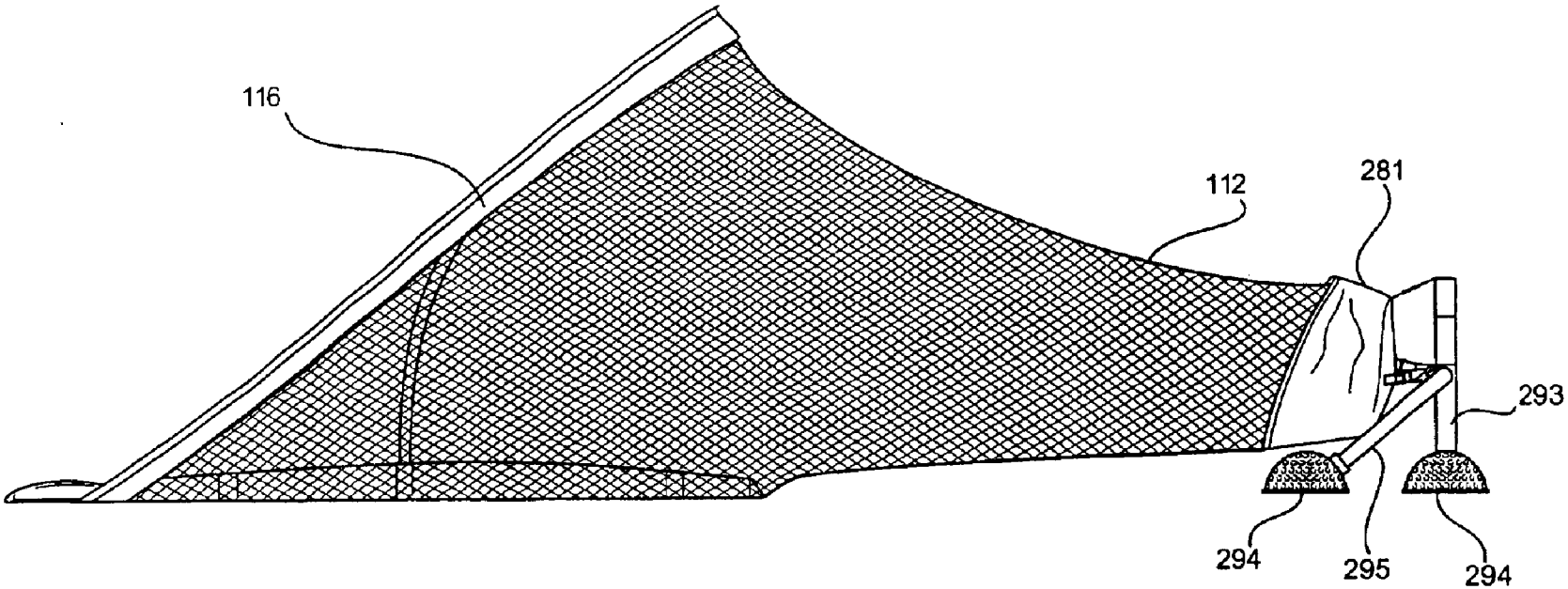
FIG. 20 is a side elevation a golf practice device in accordance with the fourth embodiment incorporating the portable support of FIG. 19*a* showing the relationship to the closed end of the net.
Figure 21:
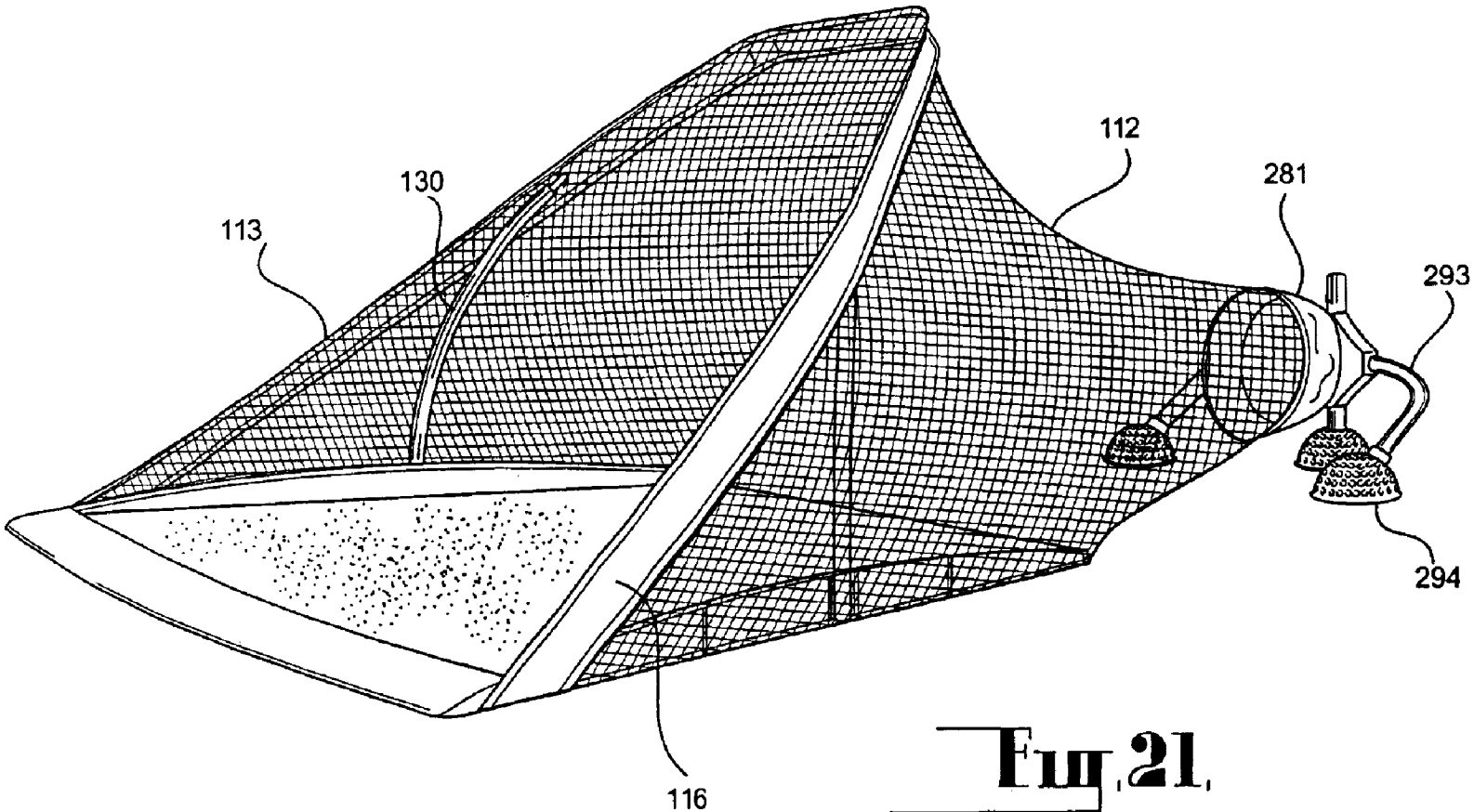
FIG. 21 is a perspective view of a golf practice device in accordance with the fourth embodiment incorporating the portable support of FIG. 19*a*.
Figure 22:
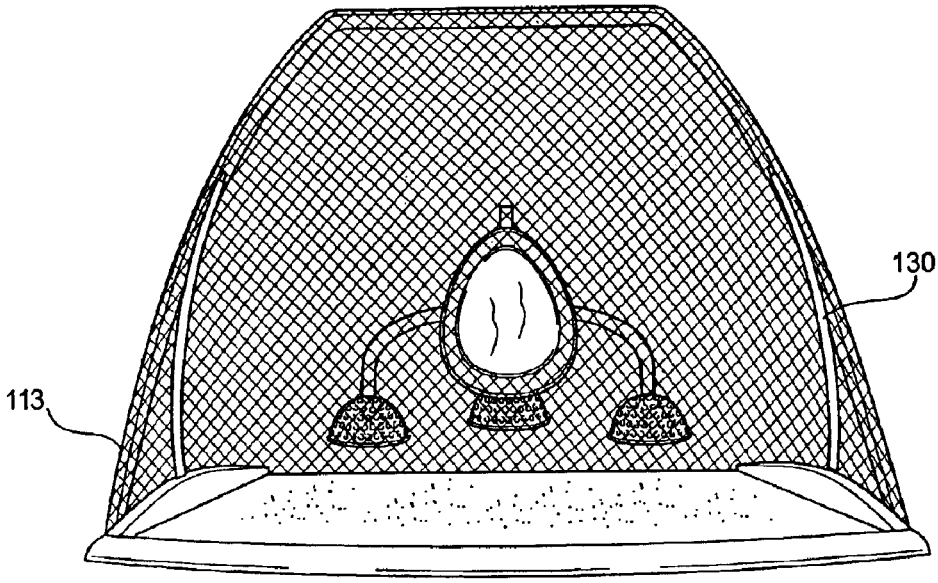
FIG. 22 is a front perspective of a golf practice device in accordance with the fourth embodiment.

The portable support 191 comprises a portable base member 192 and a resilient elongate support member 197 having a small degree of flexibility. The portable base member 192 comprises a substantially hollow, closed container having a sealable opening 193 and of substantially pyramid form having a relatively broad foot 194 and a means for supporting the elongate support member 197. As shown in FIG. 18, in the embodiment, this means for supporting comprises a recess 195 in the wall of the container adapted to receive and hold the end of the elongate support member 197. The elongate support member 197 may simply comprise a relatively strong rod or tube of wood or plastics material but is preferably a mechanism of adjustable length.

In use, the elongate support member 197 is placed within the recess 195, the portable base member 192 is filled with water through the sealable opening which is then sealed by a suitable cap. By virtue of its pyramid shape, the portable base member 192 when filled with water provides a free-standing, stable support capable of supporting the net. The limited flexibility of the elongate support member 197 enables the member to deflect when a ball strikes the net, thereby absorbing a portion of the impact.

The open end 113 of the net 112 is provided with a tensioning strip in the form of a hem 116. The open end 113 comprises a lower portion and an upper portion. The lower portion is adapted to have the base 121 at least partially overlie the lower portion and be secured by hooks or other retaining means adjacent the rear corners of the base. As mentioned above, the base surface of the rear member 125 incorporates a space 173 adapted to accommodate the tensioning strip of the lower portion of the open end 113.

The upper portion is adapted to extend above the base from adjacent the rear corners of the base to the flexible frame element 130 substantially above the base, thereby providing side portions of the net adapted to intercept the ball in the event that the ball is mis-hit by the player. The hem 116 of the central section of the upper portion of the open end 113 is adapted to receive the frame element 130 through apertures in the hem 116. In use, by virtue of the tension imposed upon the net 112 by the flexible frame element 130 which is deflected forwardly by the tension provided by the portable support 191, the upper portion of the open end 113, being of substantially curved configuration causes the side portions to adopt an enveloping configuration extending to the uppermost point or part of the frame element 130. This enveloping configuration of the side portions means that the side portions are held clear of the user in a very compact apparatus of limited height. For this reason, the embodiment, is readily usable in domestic environments.

Prior art designs such as that disclosed in GB 2140311 (Collings) also disclose side portions. However such apparatus have side portions merely as a simple additions to the main enclosure. Such additions are therefore limited in the height above the ground at which they may be attached to the support frame without interfering with swing of the user. Therefore, to provide adequate protection against mis-hit balls with such apparatus, such frames must rise considerably above the height of the user, substantially excluding them from use in domestic environments. At the same time, the added side panels mean that the net cannot be provided from a simple, one piece cylindrical construction and will therefore be more expensive to produce.

According to a fourth embodiment, the portable support comprises a support as shown in FIGS. 19*a* to 19*d*, 20, 21 and 22. The support 291 comprises an attachment member 292 supported from a substantially vertical post 293 supported from the supporting surface by a foot member 294. The support 291 further comprises two stabilizing arms 295 extending sidewardly and rearwardly from the sides of the attachment member 292. Each stabilizing arm 295 is also provided with a foot member 294 to rest on the supporting surface. In the embodiment, each foot member 295 is of substantially hemispherical shape to provide a relatively broad flat base. The stabilizing arms 295 are detachable from the attachment member 292 to facilitate transportation. The attachment member 292 is adapted to support the cup 281 and thereby apply a significant tension to the net to hold it in an extended manner to provide the substantially horn-like shape. It has been found that a portable support in accordance with this design is able to support the net while weighing considerably less than the support of the first embodiment. This is because the sidewardly and rearwardly extending arms 295 distribute the weight of the net rearwardly of the end of the net, while still being clear of the net. In this way the weight of the net cooperates with the weight of the support means to increase the frictional force provided by the feet of the support to the support surface.

Figure 23:
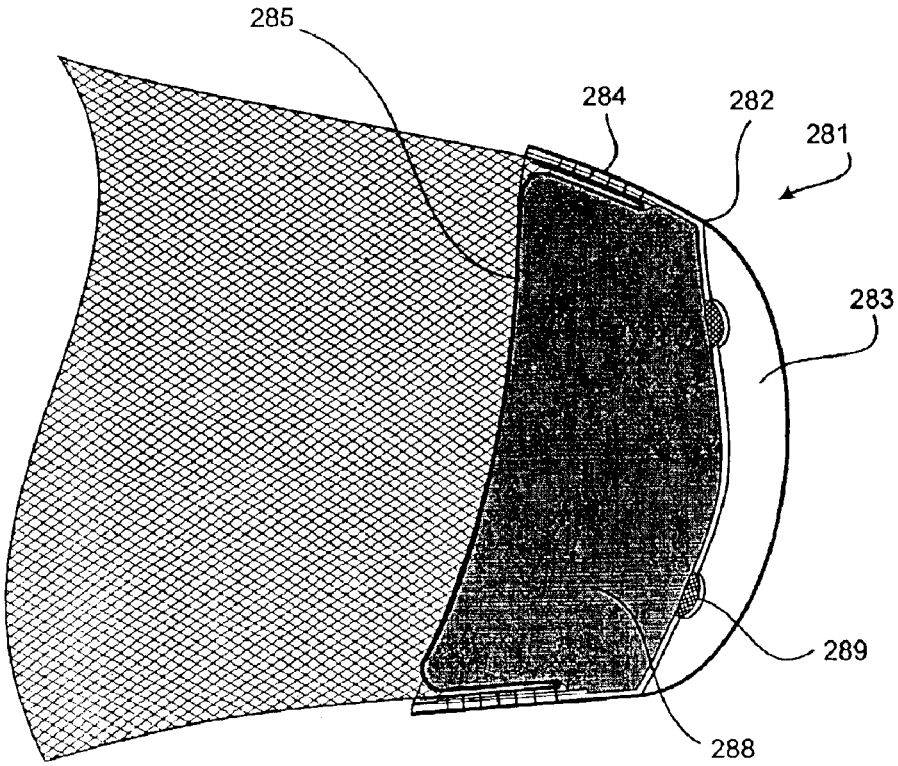
FIG. 23 is a partial section of a receiving bowl at the closed end in accordance with the fourth embodiment.
Figure 24:
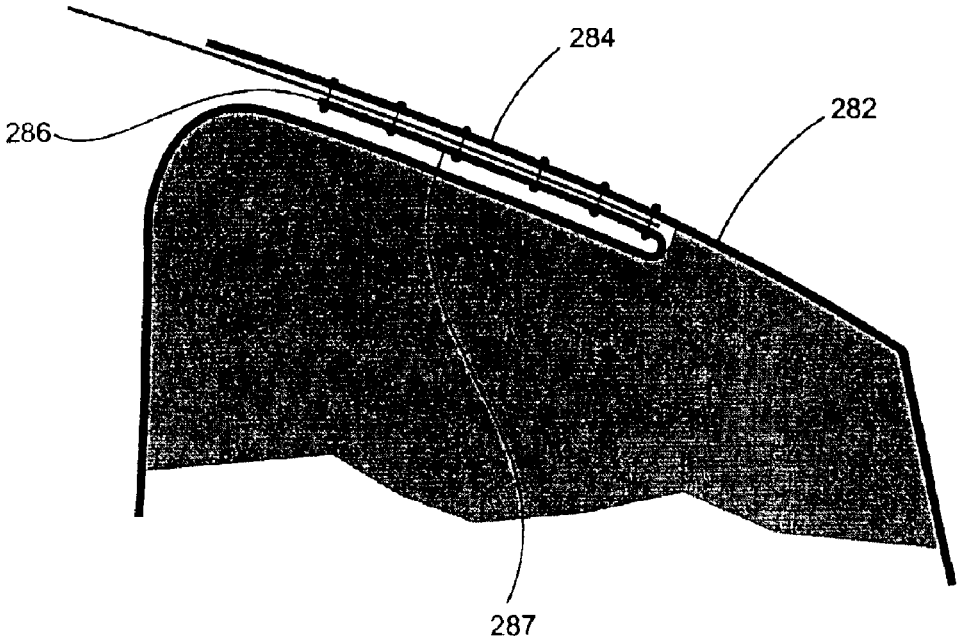
FIG. 24 is an enlargement of the side of the receiving bowl as shown in FIG. 23.

Also, in the fourth embodiment, the cup 181 of the third embodiment is replaced by a larger receiving bowl 281, as shown in FIGS. 23 and 24. The bowl 281 comprises an external shell 282 of leather having a base portion 283 and a side portion 284. The net 113 is sewn to the inner side of the side portion 284 to form the closed end of the enclosure. A leather catching wall 285 is also sewn to the inner side of the side portion 284. The wall extremity 286 is positioned to rear of the side portion 284 to provide a circumferential strip 287 to support the catching wall 285. The catching wall 285 is then folded backwards about the circumferential strip 287 to thereby enclose the receiving bowl 281 and provide a space 288 between the catching wall 285 and the external shell 282. This space is substantially filled with pellets of high-density, low-recoil foam. In addition, a plurality of apertures 289 are provided in the base portion 283 to enable air to escape upon the impact of a ball. The apertures are covered by netting on the inner surface of the base portion 283 to prevent escape of the foam. In use, when a ball strikes the leather catching wall 285, the wall 285 is deflected into the foam and tends to thereby compress it. At the same time air is expelled from the space 288 through the apertures 289 to thereby function in a manner similar to a shock-absorber to thereby dissipate energy from the ball. It has been that a receiving bowl according to this embodiment is effective in stopping balls hit even by professional golfers without any significant rebound towards the rear. Rather, the ball will fall to the lower part of the enclosure and roll gently to the base near the feet of the user. This is a major safety improvement over previous designs.

As a result of the use of the flexible frame element 130, an apparatus for practising ball sports is provided which has a number of significant advantages over those of the prior art. Firstly, an enclosure is provided which has a very simple design and which is capable of being erected by a very simple procedure, in a way that provides the appropriate level of tension to the enclosure forward of the flexible frame element 130 and to the side portions to the rear of the flexible frame element 130. With the use of the portable support 191, the apparatus may be assembled and used in environments which only provide a clear surface and no other means of support, such as a sports hall or many domestic situations. By virtue of the design, the height of the device may be limited to less that of an average player, such that it can readily be used in many domestic environments. But more importantly, due to the flexibility of the flexible frame element 130 which is able to move forwardly and sidewardly when a ball strikes the net and resiliently return to its static position, the energy absorbing properties of the apparatus as a whole are greatly enhanced compared with those having a relatively rigid support frame. In particular, it has been found by experience with the apparatus of the first and second embodiments that the use of a rigid frame member results in very rapid damage being caused to the net, especially when a ball is struck repeatedly by a powerful hitter. In contrast, the use of the flexible frame element 130 enables the frame element and thus the open end of the net to be deflected forwardly and sidewardly when a ball strikes the net, thereby permitting considerably greater deflection of the net at the point of impact so that the stress on the net at the point of impact is reduced and as a result, the life of the net is prolonged considerably. This also reduces considerably the slight risk of the ball penetrating the net when the net has been used extensively.

Nevertheless, due to the resilience of the flexible frame element 130, the net is returned to its original shape ready to receive the next ball. At the same time, the ball is returned to the playing surface adjacent to the feet of the player without requiring the player to take any special action. In addition, the apparatus is considerably lighter than prior art devices which have equivalent characteristics while retaining equivalent strength. Further, by careful design of the interrelationship between the net, the base and the flexible frame element, it has been found possible to form the enclosure from a net of simple cylindrical construction which provides the open end with a lower portion extending from adjacent the rear corners of the base beneath the base and an upper portion which extends from adjacent the rear corners of the base forwardly in an arced arrangement to adjacent the uppermost point of the flexible frame element 130, thereby providing enveloping protective side portions to the enclosure which are inherently kept clear of the user. Such net construction is therefore simple and economical to produce while providing an enclosure configuration that provides the user with the required protection by an apparatus of limited height and which is free-standing, thereby being adapted for use in domestic environments. Finally, by use of the receiving bowl of the fourth embodiment there is provided a ball stop which is adapted to dissipate practically all kinetic energy of the ball and prevent it from rebounding to any significant extent.

Throughout the specification, unless the context requires otherwise, the word "comprise" or variations such as "comprises" or "comprising", will be understood to imply the inclusion of a stated integer or group of integers but not the exclusion of any other integer or group of integers.

We claim:

1. A device for practicing golf comprising:

a base having a border and an upper surface bounded by the border, a portion of the upper surface providing a playing surface upon which a person using the device stands while striking a golf ball that rests relative to the playing surface;

an elongate enclosure for catching a golf ball that is struck, the enclosure formed of a membrane and comprising an open end and a closed end with side walls therebetween, a lower portion of the enclosure extending from the closed end to the base;

a resilient, elongate first support fixed at each end to the sides of the base to define an arcuate perimeter overlying the base, the first support supporting the upper portion of the open end of the enclosure, wherein the ends of the resilient elongate first support are fixed to the sides of the base intermediate opposite ends of said sides;

a second support adapted to support the closed end of the enclosure forward of the base wherein, in use, the second support applies a tension to the enclosure between the closed end and open end to cause the first support to resiliently flex forwardly such that the perimeter is inclined forwardly with respect to the base whereby the first support and the membrane are able to deflect when the golf ball strikes the membrane to thereby absorb kinetic energy of the golf ball.

2. The device of claim 1, wherein a segment of the perimeter of the open end underlies the base from the each side of a rear portion of the playing surface.

3. The device of claim 1, wherein the membrane is formed from cylindrical construction.

4. The device of claim 3, wherein the open end is oblique relative to the cylindrical axis.

5. The device of claim 3, wherein the closed end is transverse relative to the cylindrical axis.

6. The device of claim 1, wherein the support that supports the closed end is not connected to the base.

7. The device of claim 1, wherein the edge of the open end is supported by a resiliently flexible member.

8. The device of claim 1, wherein the top of the open end is disposed at a height that is not greater than the height of an average man standing on the playing surface.

9. The device of claim 1, wherein the enclosure has the general shape of a cylinder wherein one end of the cylinder is supported by the elongate support and the other end is gathered to provide the closed end.

10. A golf practice device, comprising:

a base having a front, a rear, and a pair of sides, and defining a playing surface upon which a person using the device is intended to stand during use, the playing surface being defined between the front, rear and sides of the base;

a flexible, resilient, elongate, upstanding frame element the ends of which are fixed to the sides of the base intermediate opposite ends of said sides, the frame element extending upwardly, said frame element having an uppermost point;

an enclosure having an open end and a closed end, the open end being supported by the upstanding frame element to define an arcuate perimeter overlying the base;

a free standing support;

the enclosure being supported in the vicinity of the closed end by the free-standing support forwardly of the front of the base to apply tension to the enclosure between the closed end and the open end whereby the enclosure defines an elongate space which is divergent from the closed end to the open end;

the enclosure having a lower portion between the closed end and the front of the base that is inclined downwardly from the closed end to enable a ball to return to the playing surface, and the open end extending rearwardly from the upstanding frame element along each side of the base to adjacent the rear of the base to thereby define lateral portions rearwardly of the upstanding frame element;

each lateral portion decreasing in height from the upstanding frame element to adjacent the rear of the base;

wherein the enclosure is formed of a membrane such that, when the device is erected, the membrane and the frame element are able to deflect when struck by a driven golf ball to thereby absorb kinetic energy of the golf ball.

11. The device of claim 10, wherein a segment of the open end underlies the base from each side rearwardly of the upstanding frame element.

12. The device of claim 10, wherein the membrane is formed from cylindrical construction.

13. The golf practice device of claim 10 wherein the frame element is caused to be resiliently deflected forwardly by the tension created in the enclosure by the free-standing support.

14. The golf practice device of claim 10 wherein the frame element is able to resiliently flex forwardly or sidewardly or both forwardly and sidewardly on said impact.

15. The golf practice device of claim 10 wherein the membrane comprises netting.

16. The golf practice device of claim 10 wherein the free-standing support comprises an element adapted to receive a counterweight.

17. The golf practice device of claim 10 wherein the free-standing support comprises a support structure adapted to support the enclosure above a supporting surface, the support structure comprising contact portions adapted to contact the supporting surface at positions intermediate the base and the closed end.

18. The golf practice device of claim 17 wherein the support structure comprises a body and a pair of arms, the arms extending from the body to contact the supporting surface at positions intermediate the base and the closed end.

19. The golf practice device of claim 18 wherein the arms extend laterally from the body in opposed directions to provide clearance from the membrane.

20. The golf practice device of claim 10 wherein the sides of the base converge from the rear to the front.

21. The golf practice device of claim 20 wherein the base is substantially trapezoidal in shape.

22. The golf practice device of claim 10 wherein the base comprises a base frame enclosing the playing surface, the base frame comprising a front member, a rear member and pair of side members, wherein the base frame members comprise a plurality of removably interconnected sub-members.

23. The golf practice device of claim 10 wherein a lower rearward portion of the membrane extends beneath the base.

24. The golf practice device of claim 10 wherein the closed end comprises an end element adapted to receive and support the membrane at the closed end.

25. The golf practice device of claim 24 wherein the end element comprises a cup-like element, and wherein the membrane is supported by the side of the cup-like element.

26. The golf practice device of claim 25 wherein the cup-like element comprises a deformable material adapted to absorb kinetic energy from a golf ball impacting the cuplike element.

27. The golf practice device of claim 26 wherein the cup-like element is formed of a leather material.

28. The golf practice device of claim 27 wherein energy-absorbing material is associated with the end element.

29. The golf practice device of claim 28 wherein the energy-absorbing material is situated within a space enclosed by the cup like element and a deformable membrane adapted to be struck by the ball.

30. The golf practice device of claim 29 wherein the energy-absorbing material comprises high-density, low-recoil foam pellets.

31. The golf practice device of claim 29 wherein the cup-like element further comprises apertures adapted to permit the release of air from the space enclosed by the cup like element and the deformable membrane.

* * * * *

UNITED STATES PATENT AND TRADEMARK OFFICE

CERTIFICATE OF CORRECTION

PATENT NO. : 6,881,154 B2
DATED : April 19, 2005
INVENTOR(S) : Neskudla et al.

It is certified that error appears in the above-identified patent and that said Letters Patent is hereby corrected as shown below:

Column 4,
Line 38, "playing surface end" should read -- playing surface and --.

Figures 15A, 15B, 15C, 15D, 15E, 15F, 15G:
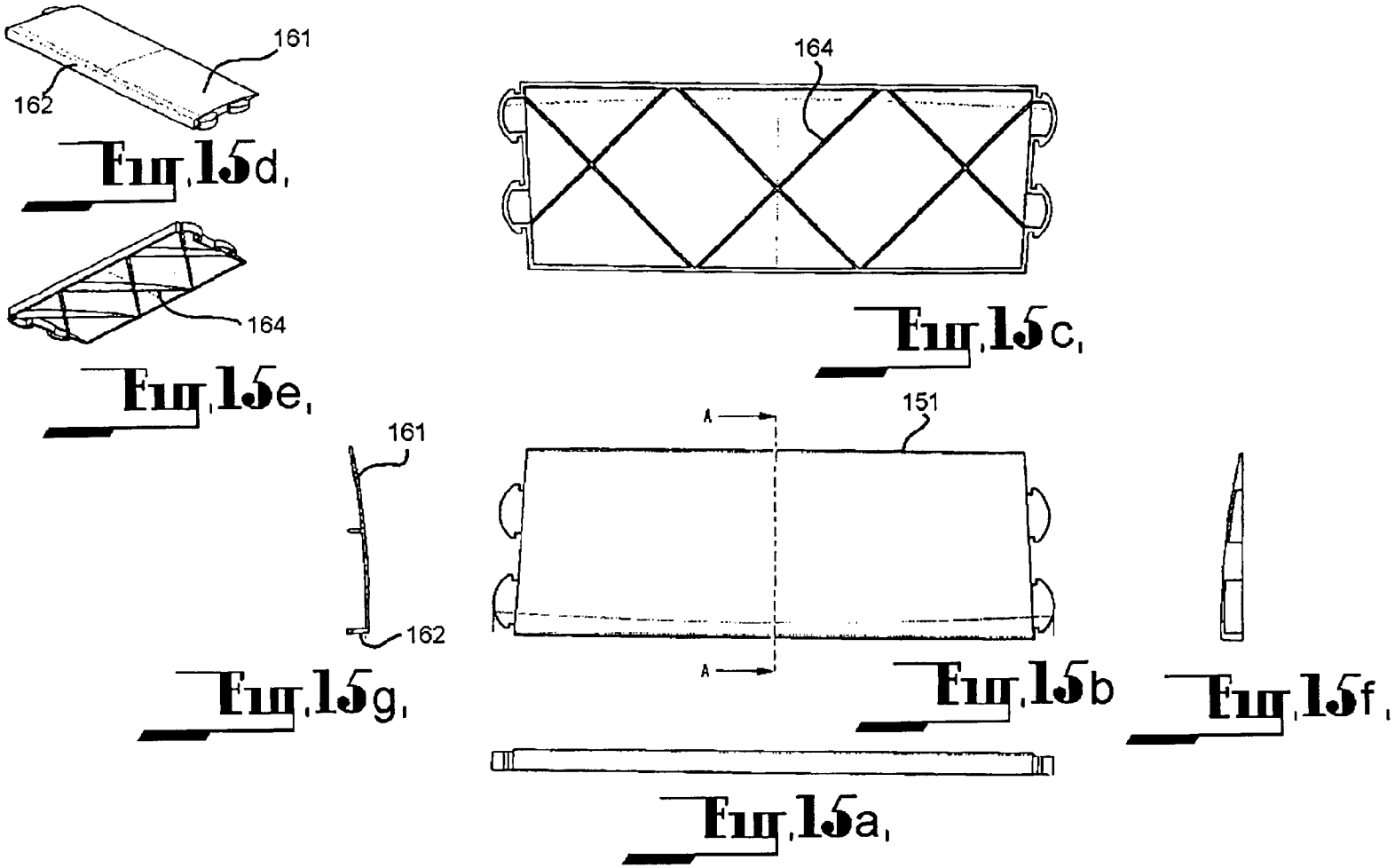
FIG. 15*a* is a side elevation of a middle sub-member of the forward member according to the embodiment.
FIG. 15*b* is a plan view of the middle sub-member shown in FIG. 15*a;*
FIG. 15*c* is a plan view of the base of middle sub-member shown in FIG. 15*a;*
FIG. 15*d* is an isometric view of the middle sub-member shown in FIG. 15*a;*
FIG. 15*e* is an alternative isometric view of the middle sub-member shown in FIG. 15*a;*
FIG. 15*f* is an end view of the middle sub-member shown in FIG. 156*a;*
FIG. 15*g* is a sectional view of the middle sub-member shown in FIG. 15*a* along section line A—A.
Figures 16A, 16B, 16C, 16D, 16E, 16F, 16G:
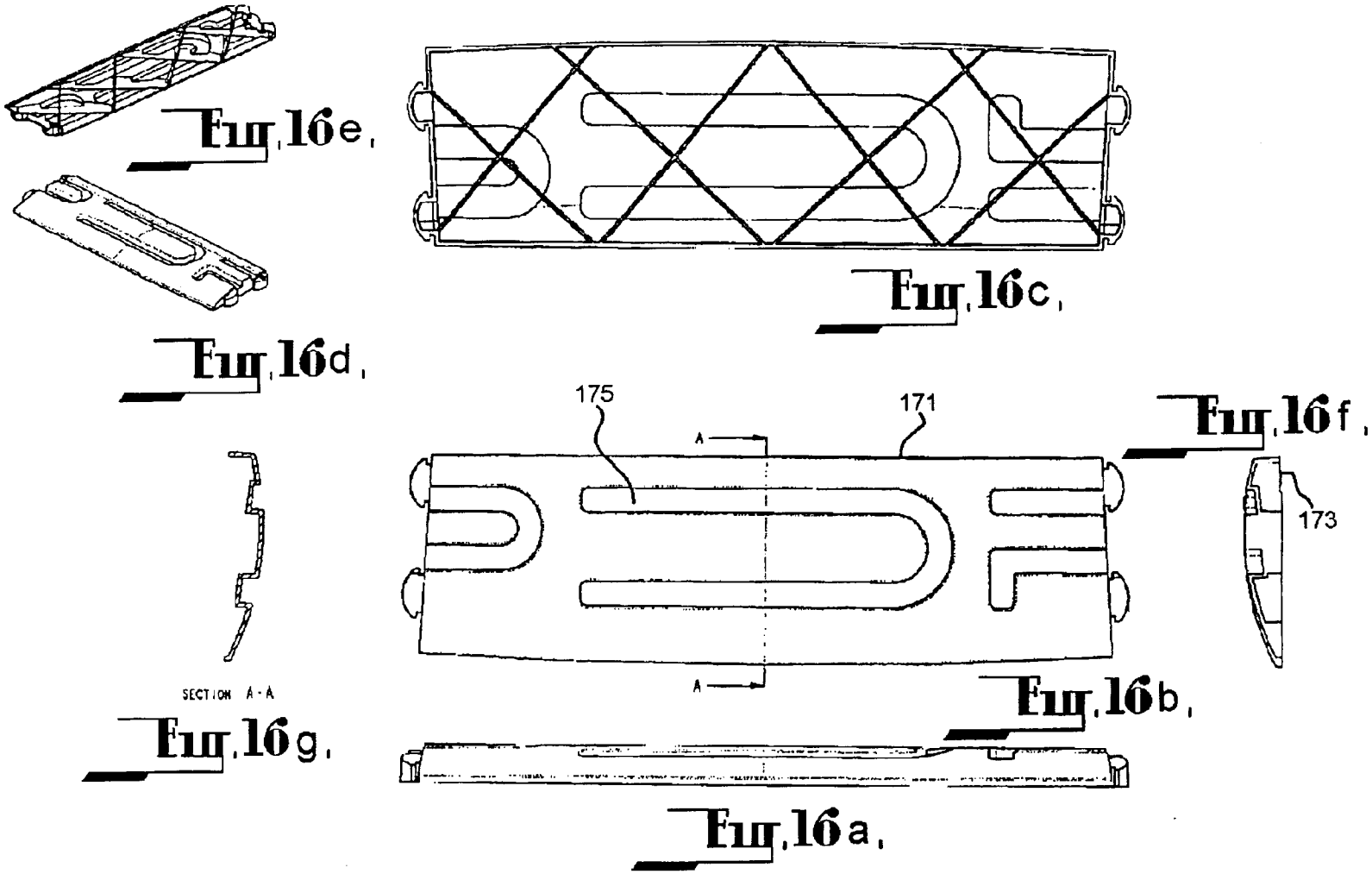
FIG. 16*a* is a side elevation of a middle sub-member of the rearward member according to the third embodiment.
FIG. 16*b* is a plan view of the middle sub-member shown in FIG. 16*a;*
FIG. 16*c* is a plan view of the base of middle sub-member shown in FIG. 16*a;*
FIG. 16*d* is an isometric view of the middle sub-member shown in FIG. 16*a;*
FIG. 16*e* is an alternative isometric view of the middle sub-member shown in FIG. 16*a;*
FIG. 16*f* is an end view of the middle sub-member shown in FIG. 16*a;*
FIG. 16*g* is a sectional view of the middle sub-member shown in FIG. 16*a* along section line A—A.

Column 5,
Line 63, "in FIG. **156*a*;" should read -- in FIG. 15*a***; --.

Signed and Sealed this

Twenty-second Day of November, 2005

JON W. DUDAS
*Director of the United States Patent and Trademark Office*